US008333096B2

(12) United States Patent
Heinz et al.

(10) Patent No.: US 8,333,096 B2
(45) Date of Patent: Dec. 18, 2012

(54) METHOD OF FORMING THREE-DIMENSIONAL MULTI-PLANE BEAM

(75) Inventors: Richard D. Heinz, Grand Haven, MI (US); Bryan E. Gould, Coopersville, MI (US)

(73) Assignee: Shape Corp., Grand Haven, MI (US)

( * ) Notice: Subject to any disclaimer, the term of this patent is extended or adjusted under 35 U.S.C. 154(b) by 135 days.

(21) Appl. No.: 12/872,602

(22) Filed: Aug. 31, 2010

(65) Prior Publication Data

US 2011/0067473 A1 Mar. 24, 2011

Related U.S. Application Data

(60) Provisional application No. 61/244,253, filed on Sep. 21, 2009.

(51) Int. Cl.
*B21D 21/00* (2006.01)

(52) U.S. Cl. ..... 72/168

(58) Field of Classification Search ..... 72/130, 72/132, 166, 168, 169
See application file for complete search history.

(56) References Cited

U.S. PATENT DOCUMENTS

| | | | |
|---|---|---|---|
| 1,533,443 | A | 4/1925 | Miller |
| 1,807,847 | A | 6/1931 | Kellogg |
| 1,857,325 | A | 5/1932 | Ottenstein |
| 2,242,135 | A | 5/1941 | Mertz |
| 2,279,197 | A | 4/1942 | Hoell |
| 2,335,028 | A | 11/1943 | Rose et al. |
| 2,880,013 | A | 3/1959 | Dean |
| 2,971,556 | A | 2/1961 | Armstrong |
| 3,076,491 | A | 2/1963 | Bruderlin |
| 3,197,990 | A | 8/1965 | Stubblefield |
| 3,258,956 | A | 7/1966 | Pinkerton et al. |
| 3,452,568 | A | 7/1969 | Vihi |
| 3,750,455 | A | 8/1973 | Stange et al. |
| 3,756,057 | A | 9/1973 | Brooks et al. |
| 3,808,863 | A | 5/1974 | Marcovitch |
| 3,845,648 | A | 11/1974 | Shubin et al. |
| 3,906,765 | A | 9/1975 | Foster |
| 3,912,295 | A | 10/1975 | Eggert, Jr. |
| 3,986,381 | A | 10/1976 | Shubin et al. |
| 4,117,702 | A | 10/1978 | Foster |
| 4,354,372 | A | 10/1982 | Inoue et al. |
| 4,391,116 | A | 7/1983 | Yogo |
| 4,530,226 | A | 7/1985 | Granzow et al. |

(Continued)

FOREIGN PATENT DOCUMENTS

| | | |
|---|---|---|
| DE | 4210227 | 9/1993 |

(Continued)

*Primary Examiner* — Faye Francis
(74) *Attorney, Agent, or Firm* — Price Heneveld LLP

(57) ABSTRACT

A method includes, in combination, a roll former with rolls configured to form a structural beam from sheet material, and a sweep unit for longitudinally sweeping a beam in any of vertical, horizontal, or combination directions. The sweep unit has a first pair of forming rolls positioned to engage first opposing sides of the structural beam and has a second pair of forming rolls positioned to engage second opposing sides of the structural beam. The sweep unit movably supports the first and second pairs of forming rolls so that any selected one of the forming rolls continuously engages an associated side of the structural beam while an associated one of the forming rolls opposing the selected one forming roll moves downstream and around the selected one forming roll. This provides a very stable beam-bending condition promoting dimensional stability during the sweeping process, and hence dimensional accuracy and repeatability.

11 Claims, 18 Drawing Sheets

U.S. PATENT DOCUMENTS 4,624,121 A 11/1986 Kitsukawa et al.
4,627,254 A 12/1986 Kitsukawa et al.
4,796,449 A 1/1989 Berne
4,850,212 A 7/1989 Frey
4,893,489 A 1/1990 Mason
4,910,984 A 3/1990 Young et al.
5,036,688 A 8/1991 Gillean
5,092,512 A 3/1992 Sturrus et al.
5,104,026 A 4/1992 Sturrus et al.
5,187,963 A 2/1993 Sutton et al.
5,197,959 A 3/1993 Buell
5,239,850 A 8/1993 Shimokata
5,305,625 A 4/1994 Heinz
5,306,058 A 4/1994 Sturrus et al.
5,412,965 A 5/1995 Kuramoto
5,425,257 A 6/1995 Kitsukawa et al.
5,454,504 A 10/1995 Sturrus
5,561,902 A 10/1996 Jacobs
5,862,694 A 1/1999 Horning
5,884,517 A 3/1999 Yogo
5,934,544 A 8/1999 Lee et al.
5,974,932 A 11/1999 Suzuki et al.
6,026,573 A 2/2000 Macchione
6,042,163 A 3/2000 Reiffer
6,079,246 A 6/2000 Caporusso et al.
6,183,013 B1 2/2001 Mackenzie et al.
6,189,354 B1 2/2001 Spath
6,240,820 B1 6/2001 Sturrus et al.
6,253,591 B1 7/2001 Sayama et al.
6,318,775 B1 11/2001 Heatherington et al.
6,349,521 B1 2/2002 McKeon et al.
6,386,011 B1 5/2002 Levy
6,484,386 B2 11/2002 Tuin et al.
6,598,446 B2 7/2003 Meliga
6,598,447 B2 7/2003 Meliga
6,662,613 B2 12/2003 Ichiryu et al.
6,695,368 B1 2/2004 Weykamp et al.
6,709,036 B1 3/2004 Evans
6,725,700 B2 4/2004 Yogo
6,813,920 B2 11/2004 Yoshida et al.
6,820,451 B2 11/2004 Renzzulla et al.
6,910,721 B2 6/2005 Bladow et al.
6,986,536 B1 1/2006 Heatherington et al.
7,066,525 B2 6/2006 Jaeger et al.
7,134,310 B2 * 11/2006 Hu ..... 72/307
7,197,824 B1 4/2007 Graber
7,337,642 B2 3/2008 Lyons et al.
7,360,386 B2 4/2008 Bair
7,530,249 B2 5/2009 Lyons et al.
2002/0174700 A1 11/2002 Meliga
2004/0154158 A1 8/2004 Sundgren et al.
2004/0164566 A1 8/2004 Jaeger et al.
2005/0062299 A1 3/2005 Renzzulla et al.
2005/0138812 A1 6/2005 Bladow et al.
2005/0162631 A1 7/2005 Graber
2006/0016078 A1 1/2006 Bladow et al.
2006/0277960 A1 12/2006 Lyons et al.
2007/0095001 A1 5/2007 Heatherington
2007/0180880 A1 8/2007 Lyons et al.

FOREIGN PATENT DOCUMENTS

EP 0362698 4/1990
EP 0870650 10/1998
JP 6117576 5/1986
JP 61132226 6/1986
JP 402015831 1/1990
JP 02037919 2/1990
JP 9141329 6/1997
JP 09225540 9/1997

* cited by examiner 50
51
54
142
PROG. COMP CONTROLLER
HYD. POWER SUPPLY
52
53
49
55
49'

58A
56A
57A
55A 55B
56B 56C
55C 57
58
56
D
55

C

METHOD OF FORMING THREE-DIMENSIONAL MULTI-PLANE BEAM

This application claims benefit under 35 USC §119(e) of provisional application Ser. No. 61/244,253, filed Sep. 21, 2009, entitled ROLL FORMER WITH THREE-DIMENSIONAL SWEEP UNIT, the entire contents of which are incorporated herein by reference. Further, the present application is related to a patent application Ser. No. 12/872,411, entitled ROLL FORMER WITH THREE-DIMENSIONAL SWEEP UNIT, filed on Aug. 31, 2010.

BACKGROUND

The present invention relates to a method of roll forming with using an in-line sweeping unit for bending roll formed structural beam components into non-linear non-planar shapes.

Roll forming apparatus exist that are capable of forming sheet into swept tubular structural beams. For example, Sturrus U.S. Pat. Nos. 5,092,512 and 5,454,504 and Lyons Published Application U.S. 2007/0180880 illustrate innovations where in-line sweep units at an end of a roll forming apparatus produce swept tubular bumper reinforcement beams. However, the apparatus of Sturrus '512 and '504 and Lyons '880 are limited to a single plane of sweep (also called "single plane of deformation") and further are limited to sweeping in a single direction from a line level of the roll forming apparatus. Some structural products require sweeps in multiple directions and in different planes, rather than being limited to a single direction from line level or being limited to a single plane of deformation.

Notably, there are many difficulties in forming structural roll formed products in multiple directions. For example, sweeping in multiple directions requires multiple moving components, each adding complexity and tolerance issues as well as a nightmare of durability and maintenance problems. Further, when a structural product is bent in multiple directions, its "flat" wall sections tend to collapse and/or undulate in unpredictable directions, resulting in poor tolerance control and poor dimensional control. This is especially true where the roll formed material is high strength steel and/or where the beams have planar walls. Still further, where high strength steel is being formed, the loads and stress on machine components become very high, resulting in substantial maintenance and the need for constant repair. For example, structural beams and bumper reinforcement beams can be 80 ksi tensile strength steel (or higher), 2.2 mm thick (or thicker), and have a 3"×4" (or more) cross-sectional envelop size. The forces resulting from attempts to sweep a beam of this makeup are extraordinarily high. The complexity increases still further if the sweep unit is expected to selectively sweep in multiple directions or planes, sweep at various selected times or longitudinal locations, and/or form relatively small radii, particularly where expected to do so "on the fly" at relatively high continuous line speeds of 100+ feet per minute. Notably, the automotive industry in particular has very tight requirements of dimensional consistency for bumper reinforcement beams and structural and frame sections, as well as high impact strength and high bending strength requirements.

SUMMARY OF THE PRESENT INVENTION

In one aspect of the present invention, an apparatus comprises a roll former with rolls constructed to form sheet material into a structural beam defining a longitudinal line level; and a sweep unit in-line with the roll former and constructed to selectively sweep the beam away from the longitudinal line level in both vertical and horizontal directions during continuous operation of the roll former.

In a narrower aspect, the sweep unit is configured and adapted to sweep the beam upward and downward vertically from the line level, and to sweep the beam right and left horizontally from the line level.

In a narrower aspect, the sweep unit includes forming members engaging top, bottom, right, and left sides of the beam, each of the forming members being movable toward the beam in conjunction with movement of an opposing one of the forming members to bend the beam.

In a still narrower aspect, the roll former and sweep unit are connected to a programmable control for simultaneous control of the roll former and sweep unit.

In a narrower aspect, the sweep unit includes beam-forming rolls for sweeping the roll formed beam on multiple continually varying planes and axes with varying radii while continuously receiving the beam from the roll forming process.

In another aspect of the present invention, an apparatus includes a roll former with rolls constructed to form sheet material into a structural beam; and a sweep unit downstream of the roll former and including beam-deforming components constructed to selectively repeatedly sweep the beam along multiple different planes and with varying radii.

In another aspect of the present invention, an apparatus includes, in combination, a roll former adapted to roll form a sheet into a continuous beam; and a sweep unit attached to the roll former with opposing rollers configured to impart a longitudinal sweep into the continuous beam in any direction vertically or horizontally or in-between.

In another aspect of the present invention, an apparatus includes, in combination, a roll former with rolls configured to form a structural beam from sheet material; and a sweep unit having a first pair of forming rolls positioned to engage first opposing sides of the structural beam and having a second pair of forming rolls positioned to engage second opposing sides of the structural beam, the sweep unit movably supporting the first and second pairs of forming rolls so that any selected one of the forming rolls continuously engages an associated side of the structural beam while an associated one of the forming rolls opposing the selected one forming roll moves downstream and around the selected one forming roll.

In another aspect of the present invention, an apparatus for imparting a curve into a structural beam that defines a line level and a line level condition, comprises a sweep unit including a beam-engaging first forming roll and an opposing beam-engaging second forming roll spaced a given distance from the first forming roll and configured to engage the continuous beam when the beam is linear and in the line level condition, and including support structure supporting the first and second forming rolls for movement in upstream and downstream directions; and a positioning mechanism constructed to move the first forming roll upstream while the first forming roll continuously engages the beam in the line level condition and also constructed to move the second forming roll downstream around a center point of the first forming roll.

In another aspect of the present invention, an apparatus for supporting a forming roll includes at least one forming roll, a carrier carrying the at least one forming roll, and a support constructed to movably support the carrier while the forming roll is engaging a continuous beam to form the beam. The apparatus further includes a mechanism for adjusting a position of the at least one forming roll so that, when moved in an upstream direction, a beam-engaging contact point of the at least one forming roll with the continuous beam continues to support the continuous beam but does not deform the continuous beam out of line level, but so that, when moved in a downstream direction, the beam-engaging contact point of the at least one forming roll moves along a path that forces the continuous beam to deform out of line level.

In another aspect of the present invention, the sweep unit includes a curvilinear (close to elliptical) positioning mechanism for forming rolls in the sweep unit that maintains a relationship of forming rolls to the beam's surfaces, and also to a backup block as the form roll carrier moves through the sweeping operation of the sweep unit.

In another aspect of the present invention, an apparatus for supporting a forming roll, comprising at least two forming rolls, a carrier carrying the at least two forming rolls, a support constructed to movably support the carrier even while the forming rolls are engaging a continuous beam to deform the beam from a linear condition, and a mechanism for adjusting a position of the at least two forming rolls including moving one of a first roll or second roll longitudinally upstream parallel a line level of the beam and moving the other of the first or second roll downstream around a center point of the one roll. By this arrangement, when moved in an upstream direction, a beam-engaging contact point of the upstream-positioned one roll maintains contact with the continuous beam and continues to support the continuous beam but does not deform the continuous beam out of line level, while the beam-engaging contact point of the other roll moves along a downstream path that forces the continuous beam to deform away from the line level around the upstream-positioned one roll.

Advantageously, the present apparatus maintains a position of the beam upstream of the sweep unit so that the upstream-portion of the beam does not go out of line level with tooling of the roll former.

Advantageously, the present apparatus includes forming rolls positioned so that a beam's longitudinal radius is formed around a downstream side of a forming roll rather than over an anvil.

Advantageously, the present sweep unit includes hydraulic cylinder-driven sweeping components using linear transducers for sweep position sensing.

In another aspect of the present invention, a method includes steps of providing a roll former with rolls constructed to form sheet material into a structural beam defining a longitudinal line level, and selectively sweeping the beam away from the longitudinal line level in both vertical and horizontal directions during continuous operation of the roll former.

In another aspect of the present invention, a method includes steps of providing a roll former with rolls constructed to form sheet material into a structural beam, providing a sweep unit downstream of the roll former and including beam-deforming components, and selectively repeatedly sweeping the beam as the beam exits the roll former along multiple different planes and with varying radii.

In another aspect of the present invention, a method includes steps of providing a roll former adapted to roll form a sheet into a continuous beam, providing a sweep unit attached to the roll former with opposing rollers configured to impart a longitudinal sweep into the continuous beam in any direction vertically or horizontally or at angles in-between, and selectively imparting at least two different sweeps into the beam.

In another aspect of the present invention, a method includes steps of providing a roll former with rolls configured to form a structural beam from sheet material, providing a sweep unit having a first pair of forming rolls positioned to engage first opposing sides of the structural beam and having a second pair of forming rolls positioned to engage second opposing sides of the structural beam, and operating the sweep unit so that all of the first and second pairs of forming rolls continuously engage the beam, but so that at least one pair of the first and second pairs of forming rolls move so that one of the forming rolls in the one pair moves downstream and into a line level of the structural beam while maintaining a constant distance to the other of the one pair of forming rolls.

In another aspect of the present invention, a method for imparting a curve into a structural beam that defines a line level and a line level condition, comprises steps of providing a sweep unit including a beam-engaging first forming roll and an opposing beam-engaging second forming roll spaced a given distance from the first forming roll and configured to engage the continuous beam when the beam is linear and in the line level condition, and including support structure supporting the first and second forming rolls for movement in upstream and downstream directions, and moving the first forming roll upstream while the first forming roll continuously engages the beam in the line level condition and also moving the second forming roll downstream around a center point of the first forming roll while maintaining a constant distance to the first forming roll.

In another aspect of the present invention, a method comprises steps of providing at least one forming roll, providing a carrier carrying the forming roll, and providing a support constructed to movably support the carrier while the forming roll is engaging a continuous beam to form the beam. The method further includes selectively adjusting a position of the at least one forming roll so that, when moved in an upstream direction, a beam-engaging contact point of the at least one forming roll with the continuous beam continues to support the continuous beam but does not deform the continuous beam out of line level, but so that, when moved in a downstream direction, the beam-engaging contact point of the at least one forming roll moves along a path that forces the continuous beam to deform out of line level.

In another aspect of the present invention, a method of making non-linear structural components comprises steps of providing a roll former with rolls configured to form a continuous beam from sheet material and defining a line level, and including a sweep unit adjacent the roll former and constructed to automatically selectively sweep the continuous beam away from the line level in multiple different directions not lying in a single plane, and including a controller operably connected to the roll former and the sweep unit for simultaneously controlling same. The method further includes roll forming a first structural beam segment, including deforming the continuous beam to have repeating identical first beam segments each with first longitudinal sections defining a first set of sweeps lying in at least two different planes, and roll forming a second structural beam including deforming the continuous beam to have repeating identical second beam segments each with second longitudinal sections defining a second set of sweeps lying in at least two different planes; with at least one of the sweeps in the first and second set of sweeps being different in radius or longitudinal length or direction or plane, such that the first and second beam segments define longitudinally-different three-dimensional shapes.

In another aspect of the present invention, a method includes steps of providing a roll former with forming rolls configured to form a continuous beam from sheet material and defining a line level, and including a sweep unit with sweeping rolls constructed to automatically selectively sweep the continuous beam away from the line level in multiple different directions not lying in a single plane; and roll forming a first structural bumper reinforcement beam with a center section and end sections and transition sections connecting the center and end sections, the first beam when in a vehicle mounted position having its center section located a horizontal distance H1 from a line connecting ends of the end sections and a vertical distance V1 from the line connecting the ends of the end sections; and further roll forming a second structural bumper reinforcement beam with a center section and end sections and transition sections connecting the center and end sections, the second beam when in a vehicle mounted position having its center section located a horizontal distance H2 from a line connecting ends of the end sections and a vertical distance V2 from the line connecting the ends of the end sections; wherein one or both of the numbers generated by (H1 minus H2) and (V1 minus V2) is non-zero, such that the first and second beams are different shapes. The method further includes assembling at least one of the first structural bumper reinforcement beams onto a first vehicle; and assembling at least one of the second structural bumper reinforcement beams onto a second vehicle.

In another aspect of the present invention, a method of bumper beam development includes steps of using existing tooling to roll form and then selectively sweep a continuous beam from sheet material and thereafter cutting the continuous beam into non-linear first beam segments, each having a center section, end sections and transition sections that position the center section a vertical distance V1 and horizontal distance H1 from a line connecting ends of the beam segments when in a vehicle mounted position; and again using the existing tooling but changing a programmed controller to form non-linear second beam segments, each having a center section, end sections, and transition sections but that position the center sectional vertical distance V2 and horizontal distance H2, at least one of (V1 minus V2) and (H1 minus H2) being non-zero; and thereafter testing the second beam segments for impact characteristics against FMVSS and insurance bumper impact standards.

In another aspect of the present invention, a product made by a roll forming process having forming rolls includes a structural tubular beam formed by forming rolls in a roll forming process to define a line level and to have a constant cross section formed in part by relatively flat wall sections, the tubular beam also being formed by sweep forming rolls in a sweep unit to have at least two different longitudinal sections that are swept in different directions from the line level, with one direction being different than and at an angle to the other direction.

These and other aspects, objects, and features of the present invention will be understood and appreciated by those skilled in the art upon studying the following specification, claims, and appended drawings.

DETAILED DESCRIPTION OF PREFERRED EMBODIMENTS

Figures 1, 2, 3, 4, 5, 6:
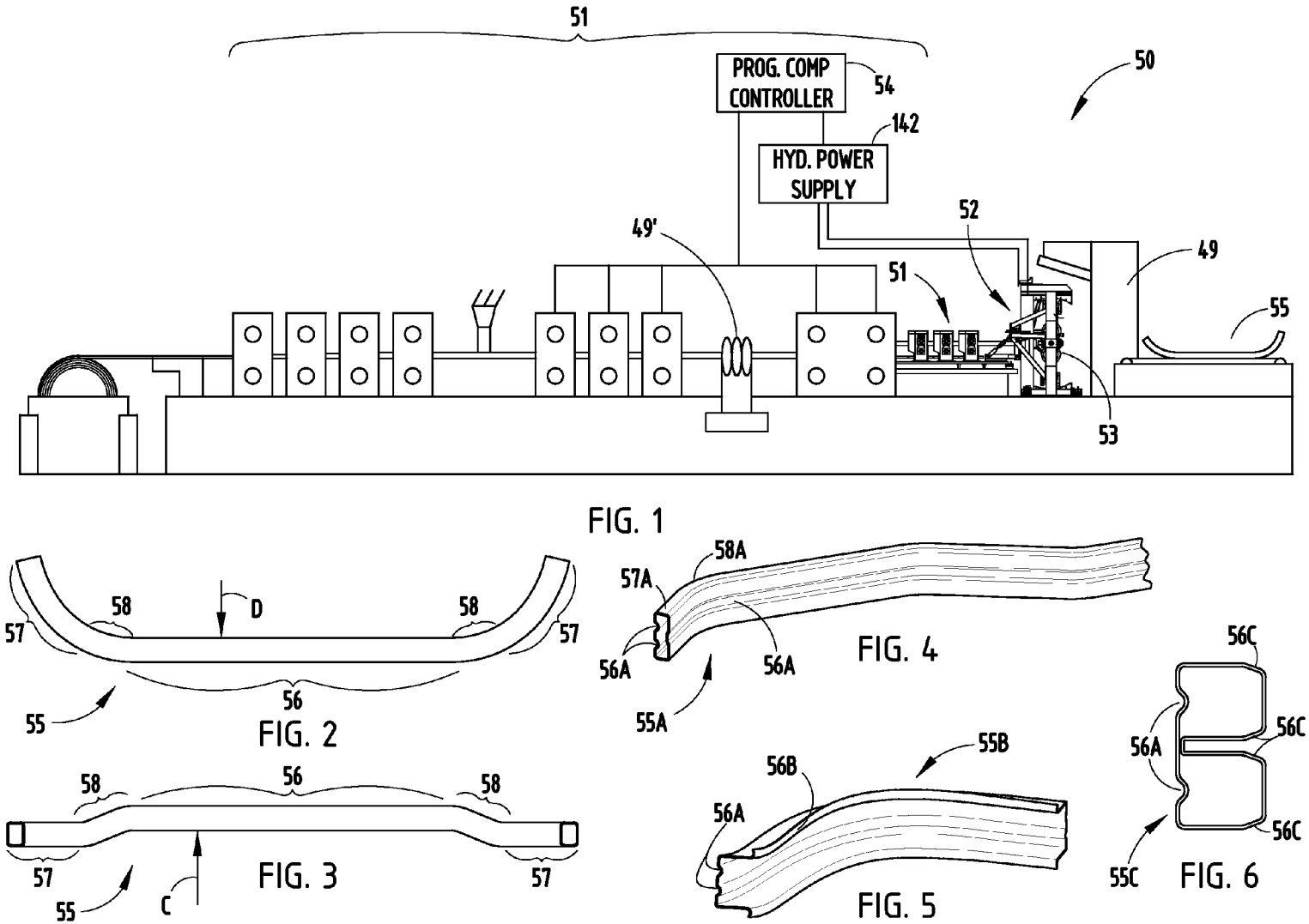
FIG. 1 is a side elevational schematic view of a system including a roll former and a sweep unit positioned in-line with and anchored to a downstream end of the roll former.
FIGS. 2-3 are top and front views of a tubular beam with generally square cross section, the beam having sweeps at each end in the top view of FIG. 2 but also back-and-forth sweeps in the front view of FIG. 3, the sweeps overlapping and hence resulting in complex non-constant sweeps that occur in multiple different directions and planes, and in different longitudinal locations.
FIGS. 4-5 are perspective fragmentary views of beams similar to FIG. 3 but having alternative cross-sectional shapes, FIG. 4 being a rectangular single tube beam, and FIG. 5 showing an open C-channel beam (also called a "hat-shaped" beam).
FIG. 6 is a cross section of a beam longitudinally similar to FIGS. 2-3, but having a double-tube "B-shaped" cross section.

The present apparatus 50 (FIG. 1) includes a roll former 51 (also called a "roll form mill" or "roll forming apparatus") having forming rolls for forming a sheet along a longitudinal line level (i.e. a longitudinal centerline of the beam in the roll former), and a multi-axis sweep unit 52 (also called a "sweeping device" or "longitudinal multi-axial sweep device") positioned at an end of and anchored to the roll former 51 for selectively sweeping a roll formed continuous beam 53 as it exits the roll former 51. The sweep unit 52 is configured to selectively form different longitudinal sweeps (i.e., longitudinal curvatures) in the continuous beam 53 in any vertical or horizontal or angled plane, and at any longitudinal position, and with any degree/sharpness of sweep (up to machine and material limits). A controller 54 is operably connected to and controls the roll former 51, sweep unit 52 and a cutoff unit 49 for coordinated action, so that when the continuous beam 53 is separated into beam segments of predetermined length by the cutoff unit 49, the segments 55 each are identical to each other and also symmetrical about a transverse center plane, and further each have a desired non-linear 3-dimensional longitudinal shape for accurate positioning of their center section to their end sections so that they can be used as bumper reinforcement beams in passenger vehicles. Advantageously, the sweep unit 52 is capable of operating on the fly during continuous high speed operation of the roll former 51. As an aside, it is noted that the sweep unit 52 is capable of making non-symmetrical beam segments as well.

For example, the illustrated beam segment 55 (also called a "bumper reinforcement beam" herein since it is useful as a vehicle bumper reinforcement beam) (FIGS. 2-4) has a relatively-square "flat-walled" tubular cross section with a longitudinal linear center section 56, co-linear aligned right/left end sections 57, and longitudinal transition sections 58 extending between the sections 56 and 57. When the beam segment 55 is in a vehicle-mounted position, the top and bottom walls of the beam segment 55 are substantially continuously horizontal along their length (with a minimum amount of undulations), and front and rear walls of the beam segment 55 are substantially continuously vertical along their length, even through the transition sections 58. The transition sections 58 position the center section 56 forward and above a line connecting the end sections 57 (when the beam segment 55 is in a vehicle-mounted position). Each of the transition sections 58 and end sections 57 include a complex bend, with part of the complex bend being upward (see FIG. 3) and part of the complex bend being in a fore-aft direction (see FIG. 2).

As can be seen by comparing FIGS. 2-3, the illustrated upward and forward bends are "independently" placed into the beam segment 55 so that the illustrated transition sections 58 and end sections 57 are more complex than a simple bend lying in a single angled plane. This allows the center section 56 to be positioned for connection to a vehicle frame, while the end sections 57 and transition sections 58 are positioned as needed for aesthetics and bumper function. For example, bumper function can be driven by FMVSS (federal motor vehicle safety standards) bumper safety requirements (including height and fore-aft relation to the vehicle) and/or for trailer hitch requirements (also including height and fore-aft relation to the vehicle) and/or for aesthetics (i.e., to match a desired front or rear fascia and appearance). Further, the cross section must maintain its shape along all portions of its length in order to maintain its impact and load-bearing strength. Restated, the beam 55 must preferably not be distorted toward a rhombus or trapezoidal shape when swept, even though a part of the sweep deformation is at an angle to vertical and to horizontal such that there is a tendency to change its orthogonal shape during the sweep operation toward a rhombus shape or parallelogram shape.

The present apparatus including sweep unit 52 is particularly well suited to prevent undesired deformation, including minimal distortion toward a rhombus shape and also minimal distortion toward undulating wall shapes. Specifically, high strength steels, when compressed, tend to form undulations. By using the present sweep unit, compressive stresses are minimized and tensile forces are maximized, due in significant part to bending the continuous beam around one forming rolls while wrapping an opposing forming roll around a downstream side of the one forming rolls, as discussed below.

An important benefit of the present innovation is that a single set of tooling on the roll former 51 and on sweep unit 52 can be used to manufacture different beams for different vehicles, where the beams have similar cross sectional shapes but different bends. Further, the set up time and/or down time between production runs of the different beams is reduced essentially to zero since the change is limited to a program control change in the programmable controller controlling operation of the sweep unit. This results in substantial cost savings and reduced capital investment. Specifically, the present innovation allows instantaneous or "on the fly" adjustment during high speed operation of a roll former and sweep unit from a first beam having a first relationship of its center section to its end sections, to a second beam having a different second relationship of its center section to its end sections.

Specifically, our testing has shown that a particular beam cross section can often be used for different vehicles, except that the different vehicles often have a different height of their frame rail tips to the ground and a different relationship of the frame rail tips to the bumper beam's preferred center height. Further, bumper beams in different vehicles have a different fore-aft relation to the vehicle's frame rail tips, to the vehicle's wheels, and to other vehicle components. For example, vehicles from a same model style may have a different fascia package (i.e., requiring a differently-shaped reinforcement beam), or may have different options and vehicle accessories (such as different wheel diameters or suspension packages or trailering options) or have different vehicle weights (such as due to added vehicle accessories), all of which may result in the need for a modified bumper system where the height and/or fore-aft position of the beam's center section to beam's end sections are changed. Further, vehicle manufacturing companies often develop a new vehicle by starting with an "old" vehicle, then proceeding to modify its frame, wheels, suspension, fascia, and/or other components.

Traditionally, these new vehicles could not use the old bumper system since bumper mounting locations were different and also different bumper beam strengths were needed. Thus historically, a completely new bumper development program was initiated, where for each new style vehicle, the bumper beam cross section, shape, material, and mounting was developed and optimized through testing. This results in long bumper development programs costing hundreds of thousands of dollars, new tooling, new fixturing, and additional inventory. Using the present innovation, the bumper systems must still be tested and certified, but the basic bumper beam segment can be made using the same rolls and tooling, but with sweeps being adjusted to position the beam segment's center section at an optimal (different) location relative to its end sections for each individual model or vehicle. At the same time, each bumper system can be optimized through material selection, by controlling shapes of the transition sections, and/or through beam-attached beam-section-specific internal/external stiffeners.

As a result, one set of tooling (i.e., one complete set of forming rolls on the roll former and potentially also one set of sweep-forming rolls on the sweep unit) can be used to manufacture two different beams, thus eliminating the need for two different sets of roll form tooling. Further, there is no changeover when switching between runs, nor any lost time due to set up, since the controller is programmed to automatically selectively produce both types of beams.

Notably, the illustrated bumper beam segment 55 (FIGS. 2-3) has a square cross section, but the top and bottom walls of all sections 55-57 are relatively horizontal throughout, and the front and rear walls of all sections 55-57 are relatively vertical throughout. It is preferable that these horizontal and vertical walls be maintained in their pre-swept orientations, so that beam impact strength is not lost or compromised, and so that the weight-carrying function and capabilities of the beam are not compromised. It is noted that the front wall in the illustrated beam segment 55 in FIG. 4 includes two channel ribs and the rear wall includes one channel rib for stiffness. However, alternative cross-sectional shapes are contemplated, including more or less ribs, and different cross-sectional sizes. For example, the beam 55A in FIG. 4 defines a single tube beam having about a 4:1 height to depth ratio, while the beam 55B in FIG. 5 illustrates an open channel U-shaped beam of about 1.5:1 ratio, and the beam 55C in FIG. 6 illustrates a multi-spaced-tube (B-shaped) beam with about 2.5:1 height to depth ratio. Further, each beam in FIGS. 4-6 has channel rib(s) 56A on its front wall (and/or rear wall) for increased stiffness and improved impact properties. The beam 55B in FIG. 6 also has rear flanges 56B or angled rear wall portions 56C on each horizontal wall for stiffness and also for improved air flow past the beam. The beam 55B in FIG. 5 has two stiffening channels in its front wall, and also has vertical up/down stiffening flanges on a rear edge of its horizontal top and bottom walls. Notably, it is contemplated that back straps could be added to the beam 55B of FIG. 5 to reduce a tendency of its horizontal walls to spread upon impact.

It is contemplated that the present inventive concepts will work on many different beams, including different closed tubular cross sections (such as O, P, B, D, square, rectangular, hexagon, or the like) and also beams having open cross sections (such as L, X, U, T, I, Z or the like). Also, it is contemplated that the longitudinal curvatures given to the continuous beam by the sweep unit 52 can define a constant radius, or changing radius, and also can be made in any direction or at any longitudinal location along the continuous beam. Also, straight (un-deformed) sections can be left in the beam if desired, as illustrated by FIGS. 2-3, or the center sections can also be swept to include a longitudinal curvature. Notably, the illustrated beam segment can be used as a bumper reinforcement beam, but it is contemplated that other structural components for vehicles can be made, such as vehicle frame rails and cross-frame supports. Also, it is contemplated that the present inventive concepts can be used to make structural and non-structural components in many other environments, such as furniture, construction equipment, farm equipment, buildings, machinery, and in any other application where a non-linear structural beam or non-linear elongated structural member with strength is needed.

The roll former 51 includes a machine frame 61, and a plurality of axle-supported driven sweep forming rolls 70 for forming a strip of high strength sheet material (such as steel of 40 ksi tensile strength, or more preferably 80 ksi or greater such as up to 120-220 ksi tensile strength) into a cross-sectional shape of the continuous beam 53. The illustrated roll former 51 also includes a welder 49' for welding the cross-sectional shape into a permanent tubular shape and a guillotine-type cut-off device 49. The illustrated roll former 51 includes rolls configured to form the continuous linear beam 53 (see FIGS. 2-6), the linear shape extending along a line level of the roll former 51 up to the sweep unit 52. For example, see Sturrus U.S. Pat. Nos. 5,092,512 and 5,454,504 and Lyons 2007/0180880 (the entire contents of all of which are incorporated herein for their teachings), which disclose a roll forming apparatus and process with sweep station of interest.

Figure 8:
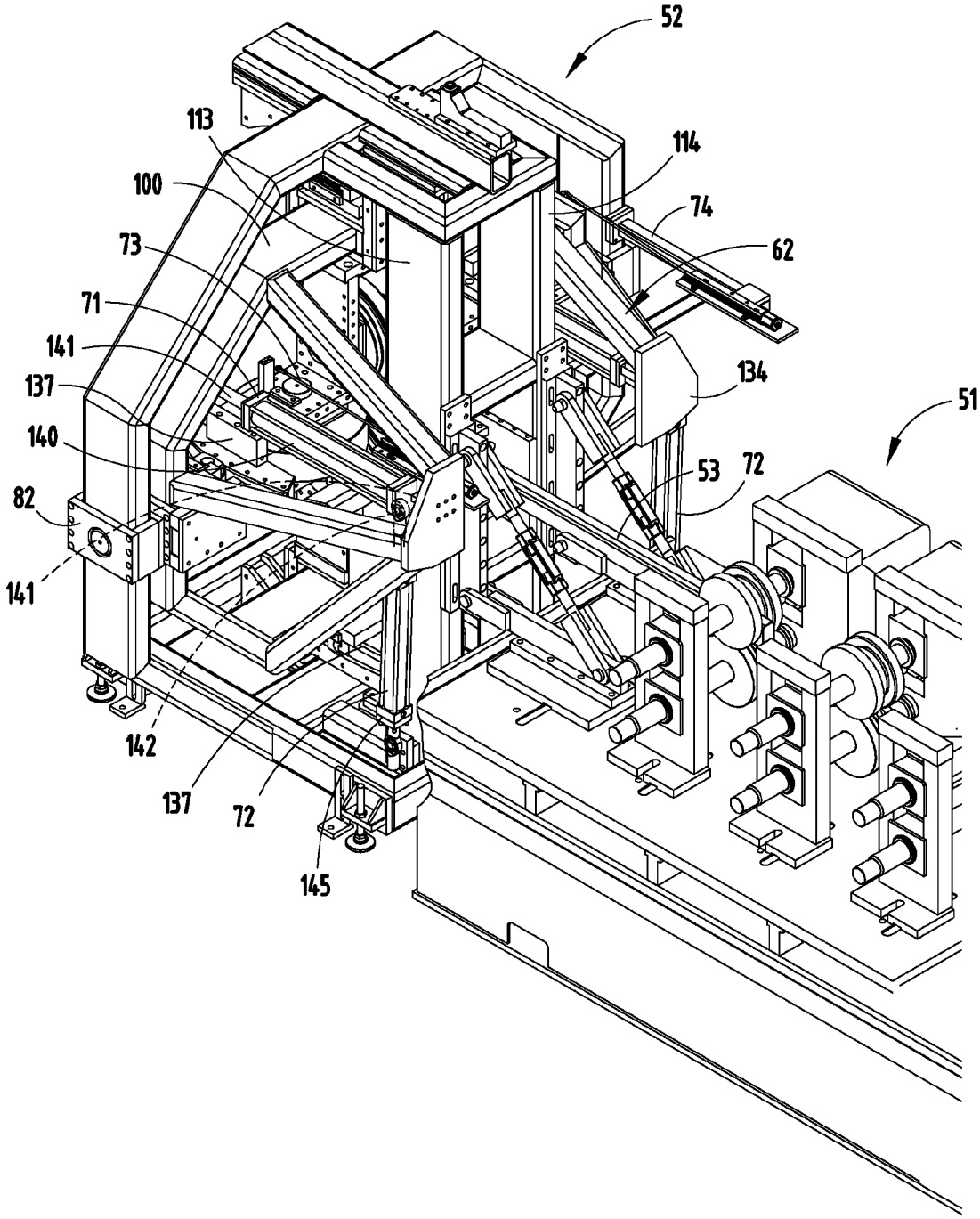
Figure 9:
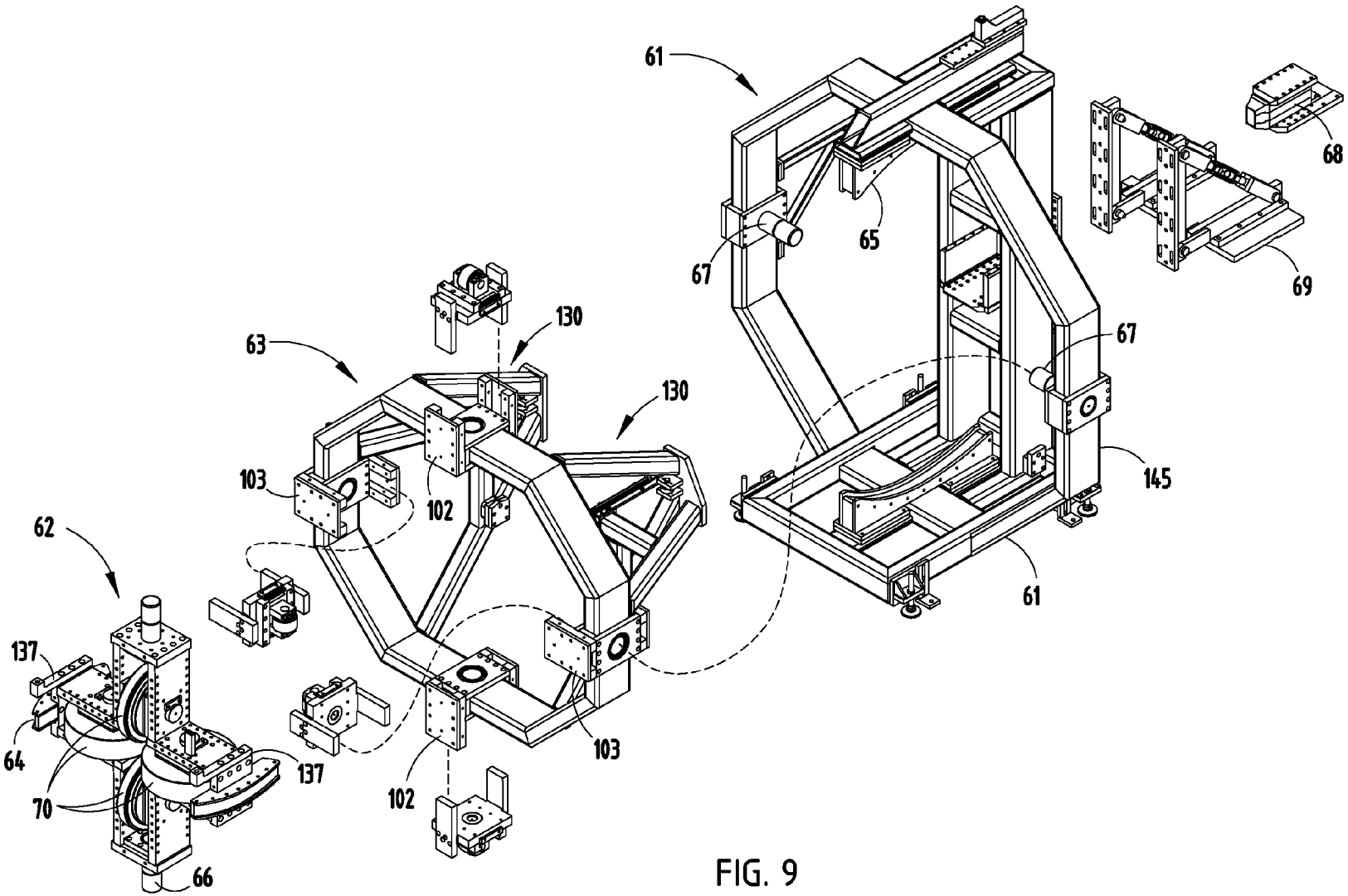
FIG. 9 is an exploded perspective view of FIG. 7 showing various major subassemblies of the sweep unit, including the main frame, the ring-shaped intermediate frame, the form roll carrier, the anchor attachment frame, and the backup block.
Figure 10:
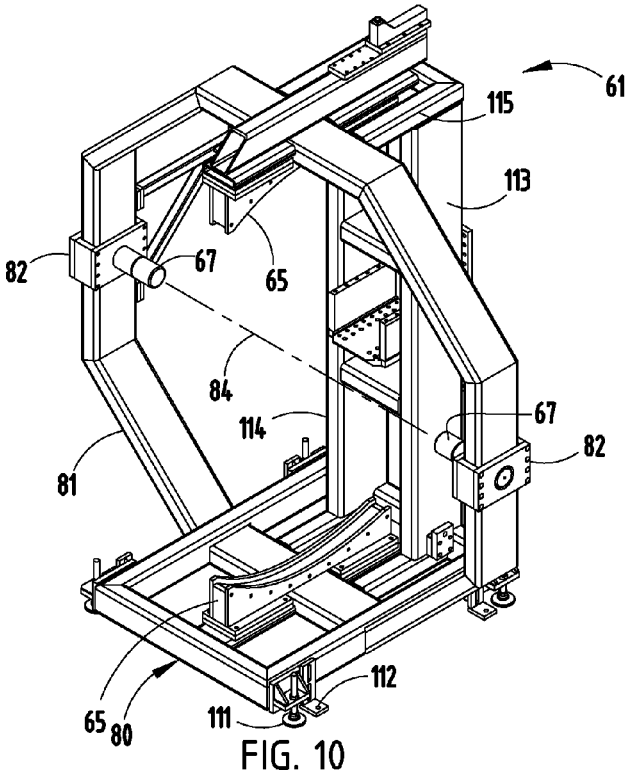
FIGS. 10-12 are enlarged downstream-side perspective, upstream-side perspective and LH side views of the main frame in FIG. 9.
Figure 11:
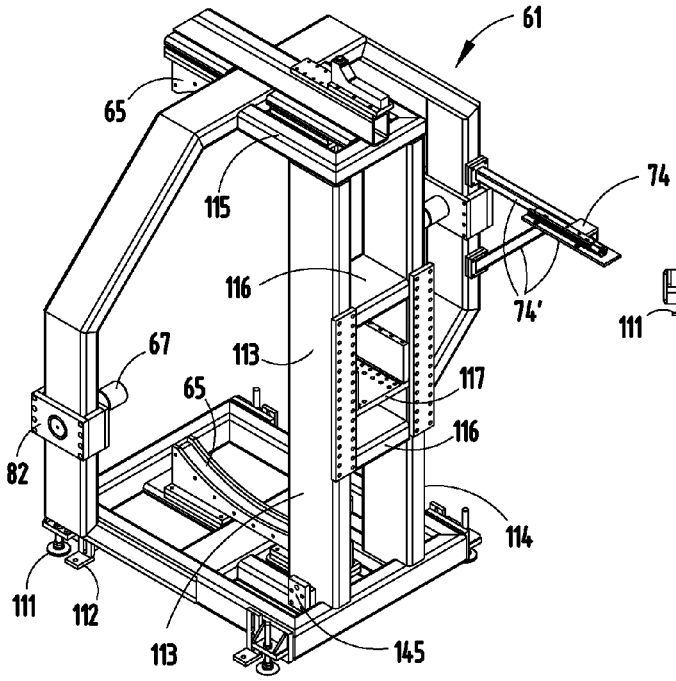
Figure 12:
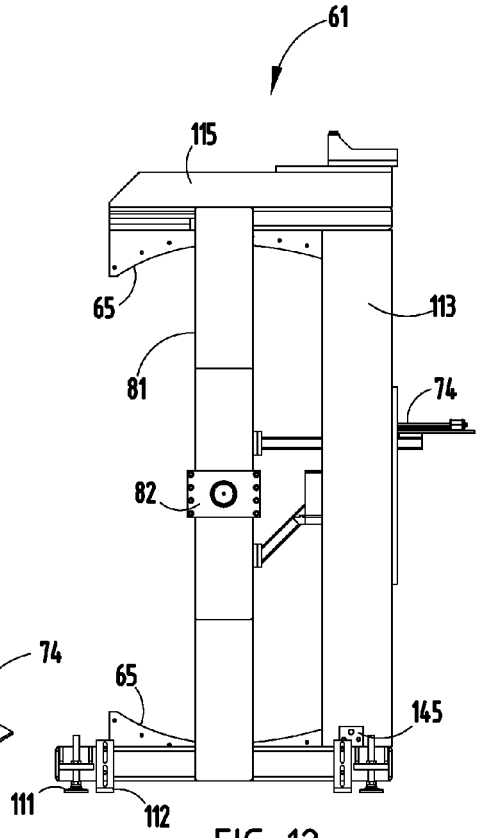
Figure 13:
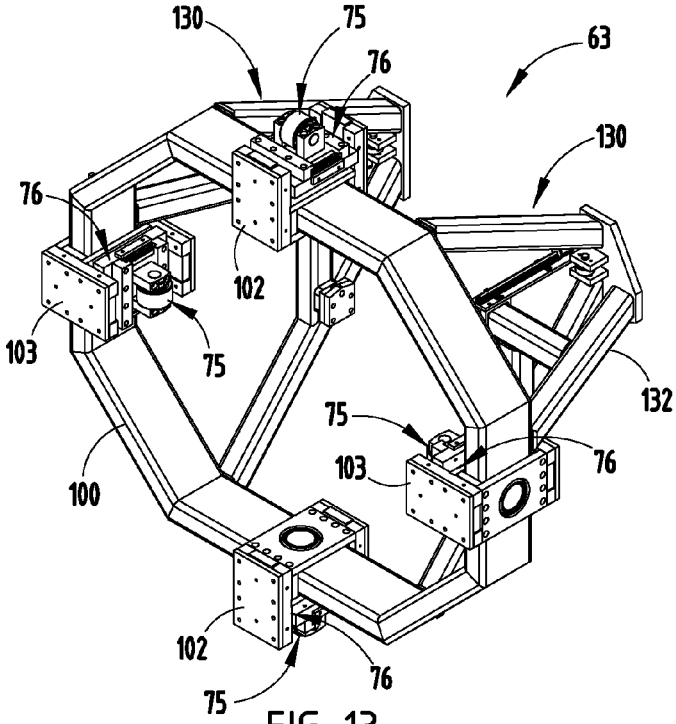
FIGS. 13-15 are enlarged downstream-side perspective, upstream-side perspective and LH side views of the ring-shaped intermediate frame in FIG. 9.
Figure 15:
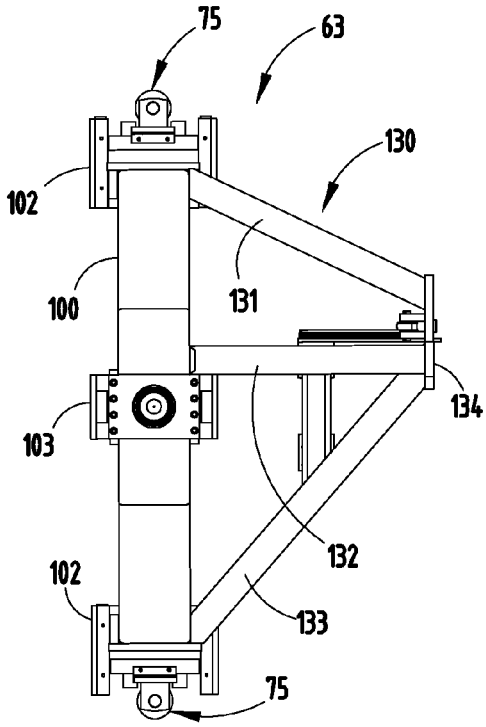
Figure 14:
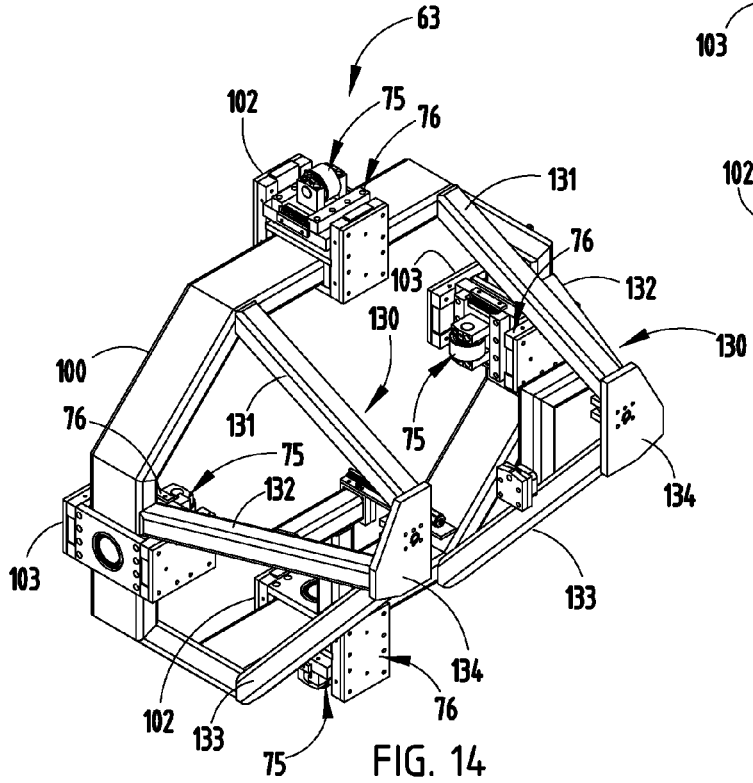
Figure 22:
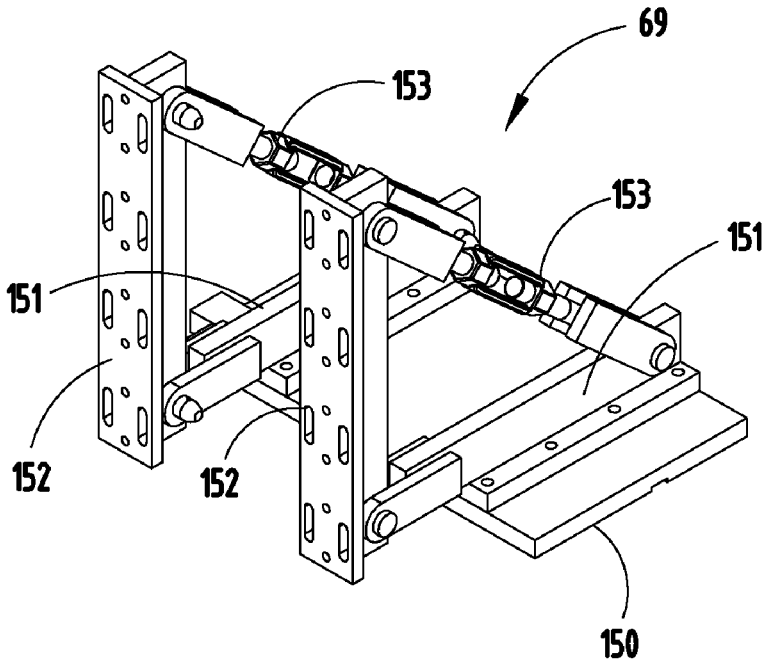
FIGS. 22-23 are downstream-side perspective and LH side views of the anchor attachment frame of FIG. 9.
Figure 23:
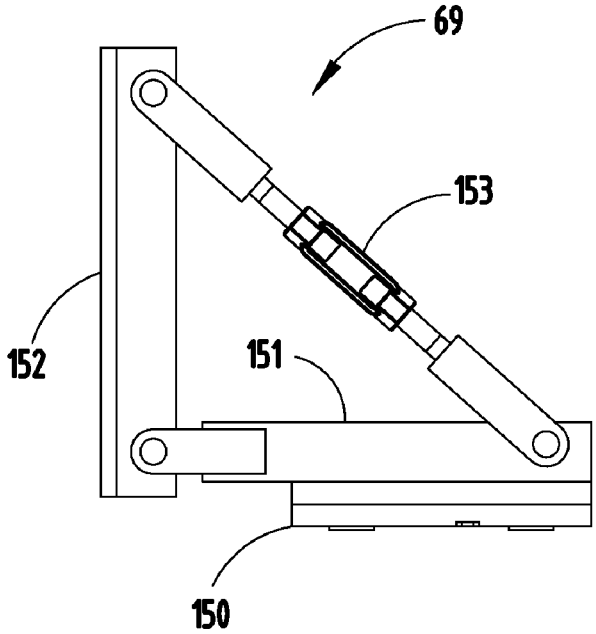

List of component names for the sweep unit 52:

61. main frame/machine base (see FIGS. 9, 10-12)
62. vertical axis frame/form roll carrier (see FIGS. 9, 16-21)
63. horizontal axis intermediate frame (see FIGS. 9, 13-15)
64. vertical axis "elliptical" curvilinear bearing races (FIGS. 18-21, 34,39-40)
65. horizontal axis "elliptical" curvilinear bearing races 18-21, 31, 41-42)
66. vertical axis axle (FIG. 8)
67. horizontal axis axle (FIG. 8)
68. backup block (see FIG. 9)
69. sweep unit to roll mill adjustable attachment frame (see FIGS. 22-23)
70. sweep forming roll (also called "sweep rolls") in sweep unit
71. vertical axis positioning actuators (cylinders and extendable rods) (FIG. 8)
72. horizontal axis positioning actuators (cylinders and extendable rods) (FIG. 8)
73. vertical axis position sensor (FIG. 8)
74. horizontal axis position sensor (FIG. 8)
75. cam yoke roller and mount (also called "sweep support rolls") (FIGS. 18-21, 39-42)
76. cam yoke roller guide mechanism (FIGS. 39-42)

The main frame/machine base 61 (FIGS. 10-12) forms a part of sweep unit 52 and also supports the other components of the present sweep unit 52. The base 61 includes a floor-engaging platform 80 and a fixed outer structural ring 81 of tube sections forming an octagonal shape. Axle holders 82 on sides of the structural ring 81 support co-linear axles 67, the axles 67 extending inward. The axles 67 lie along and define a horizontal sweep axis 84. The illustrated outer structural ring 81 is eight-sided, but it is contemplated that other shapes will work. The horizontal axis position sensor 74 is mounted on brackets 74' attached to the structural ring 81 of the base 61, and a cord (or stem or flexible strip) extends from the sensor 74 to the intermediate frame 63 at a location spaced from the axis 84 for measuring an angular position of the intermediate frame 63.

The horizontal axis "elliptical" curvilinear bearing races 65 are located at top and bottom locations on an inside of the outer structural ring 81. The races 65 have an inwardly facing bearing surfaces, each including particularly shaped upstream and downstream sections. The upstream section of the bearing surface defines a path so that an upstream-moving sweep-forming roller 70 on the sweep unit 52 moves linearly parallel the line level of the roll former 51 (i.e., parallel a length of the continuous beam 53) (see FIGS. 27, 31, 32, and 41). The downstream section of the bearing surface defines a path so that a downstream-moving sweep-forming roller 70 (i.e., the sweep-forming roller 70 on an opposite side of the continuous beam 53 from the upstream-moving sweep-forming roller 70) moves around a center point of the upstream-moving sweep-forming roller 70. In other words, the downstream-moving sweep-forming roller 70 moves around the other (upstream-moving) sweep-forming roller 70 at a constant distance thereto but in a downstream direction. This causes the downstream-moving sweep-forming roller 70 to move into the continuous beam 53, deforming it around the upstream-moving sweep forming roller 70, while both opposing rollers 70 continue to engage and support walls of the continuous beam 53 at the bend region in the sweep unit 52.

The rectangular floor-engaging platform 80 (FIGS. 10-12) includes adjustable feet 111 and floor-attached anchoring brackets 112. Parallel uprights 113 and 114 extend upwardly from the platform 80, and they support a top ring stabilizer 115 that connects to a top of the structural ring 81. Transverse beams 116 tie the parallel uprights 113/114 together, and also a support plate 117 attaches between the uprights 113/114. The support plate 117 supports the backup block 68, which is attached to same. Also, the anchor attachment frame 69 is attached to an upstream side of the uprights 113/114 for anchoring the sweep unit 52 to the frame of the roll former 51.

The vertical axis frame 62 (also called "sweep roll carrier" herein) (FIGS. 16-17) is "+" shaped, with each leg of the "+" shape forming a U-shaped roller support 90. The four orthogonally positioned roller supports 90 are interconnected and positioned to support four forming rolls 70 around the four sides of the continuous beam 53, with pairs of the forming rolls 70 each being positioned to engage opposing sides of the continuous beam 53. Each roller support 90 includes a pair of parallel roll-supporting side plates 91 and 92 connected by an end plate 93. Each forming roll 70 is supported on an axle 94 that extends through the side plates 91 and 92. A flat bearing is located on an inside of each side plate (91, 92) for supporting a side of each associated roll(s) 70 to maintain their perpendicularity within the legs of the roller supports 90 and to the vertical axis frame 62. Vertical axles 66 extend upward and downward from top and bottom sections of the vertically-spaced end plates 93. Right and left vertical axis "elliptical" curvilinear bearing races 64 are located on the right and left end plates 93. The bearing races 64 have an outwardly-facing bearing surface that engage support rolls 75, and include upstream and downstream sections designed to engage the support rolls 75 which in turn maintain engagement of the mating opposing sweep forming rollers 70 with the continuous beam 53 while deforming the beam 53.

Figure 16:
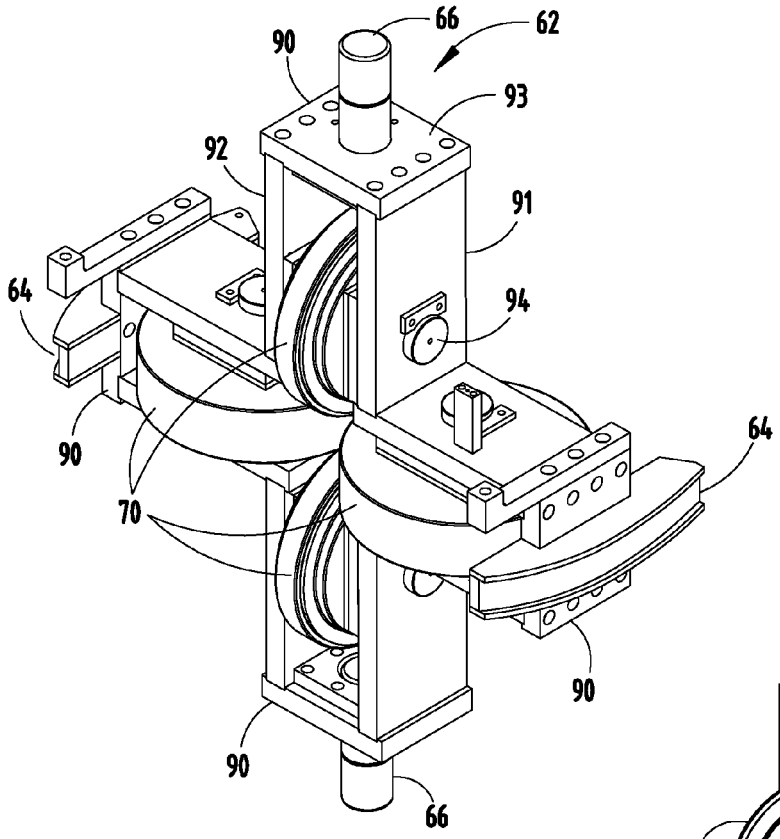
FIGS. 16-17 are enlarged downstream-side perspective and LH side views of the form roll carrier in FIG. 9.
Figure 17:
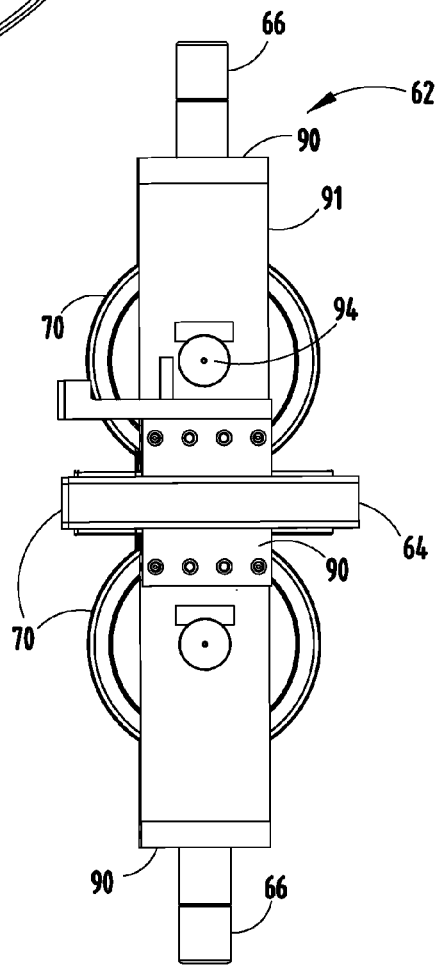
Figure 18:
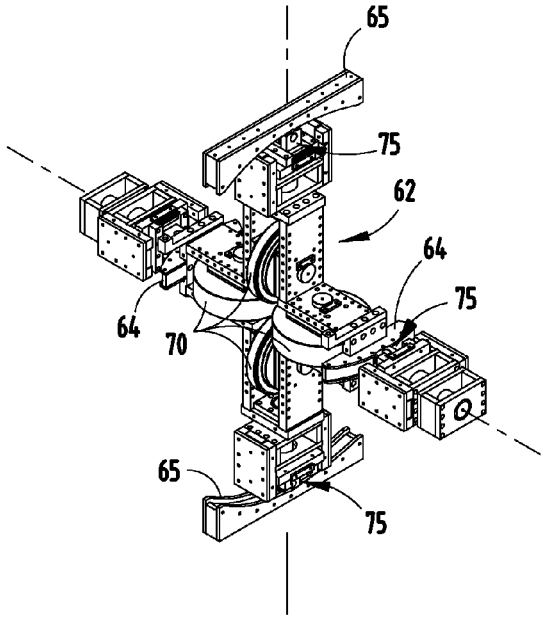
FIGS. 18-21 are enlarged downstream-side perspective, top, LH side and downstream-face views of the roll carrier in FIG. 16 but also showing the bearing support arrangement.
Figure 19:
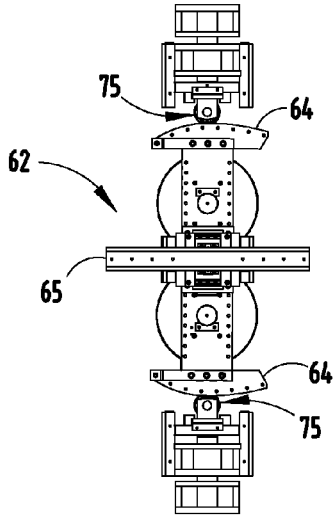
Figure 20:
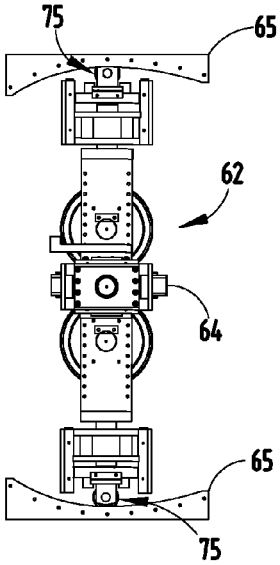
Figure 21:
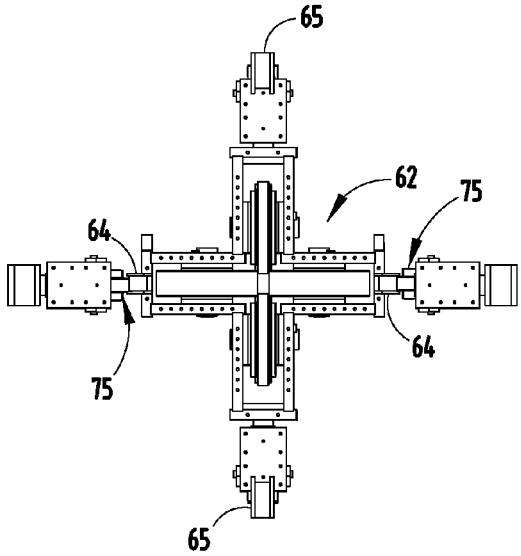

Specifically, the vertical axis "elliptical" curvilinear bearing races 64 are located at right and left locations on an outside of the carrier 62 (FIGS. 16-17). The races 64 have an outwardly facing bearing surface including upstream and downstream sections. The upstream section of the bearing surface defines a path so that an upstream-moving sweep-forming roller 70 (as supported by the support roll 75) on the sweep unit 52 moves linearly parallel the line level (i.e., parallel a length of the continuous beam 53) (see FIGS. 27, 34-36, 37, and 42). The downstream section of the bearing surface defines a path so that a downstream-moving sweep-forming roller 70 (i.e., the sweep-forming roller 70 on an opposite side of the continuous beam 53 from the upstream-moving sweep-forming roller 70) moves around a center point of the upstream-moving sweep-forming roller 70. In other words, the downstream-moving sweep-forming roller 70 moves around the other (upstream-moving) sweep-forming roller 70 at a constant distance thereto but in a downstream direction and "into" a path of the continuous beam 53 coming from the roll former 51.

FIGS. 18-21, 38-43 show a relationship of the bearing races 64, 65 with cam yoke roller and mounts 75 and the cam yoke roller guide mechanism 76. The cam yoke roller and mounts 75 each include a roller 120 (FIGS. 41 and 43) with mount 121 having side legs supporting the roller 120 for rolling engagement with the curvilinear surface of the bearing races 64. The cam yoke roller guide mechanism 76 includes a plurality of roller bearings 122 for slidably engaging a flat back surface of the mount 121, allowing the arrangement to adjust for lateral stress.

The horizontal axis frame 63 (FIGS. 13-15) includes an inner structural ring 100 that fits within the outer structural ring 81 of main frame/machine base 61 and that extends around/outside of the vertical axis frame/roll carrier 62. The illustrated inner structural ring 100 includes multiple short tube sections welded together to form an eight-sided structure, similar to but smaller than the outer structural ring 81. A reinforcing subframe 130 is formed on each lateral side of the inner structural ring 100, and each includes three tube sections 131-133 that are attached to the inner structural ring 100 at top, side and bottom locations. The three tube sections 131-133 converge and are bolted (or otherwise secured, such as by welding) to a vertical plate 134, with right and left plates 134 being collinear and positioned on opposite sides of the continuous beam 53 (i.e., on opposite sides of the uprights 113/114). The primary intent of the subframes 130 is for attaching the vertical axis actuators, though it is noted that they also strength the structural ring 100 to some extent.

The reinforcing subframe 130 stabilizes the inner structural ring 100 and prevents excessive distortion despite the large stresses that the ring 100 experiences during sweeping operations. Right and left vertical axis actuators 71 (FIG. 8) extend between the plates 134 and brackets 137 on the sweep roll carrier 62, and each actuator 71 includes a cylinder 140 and extendable rod 141 controlled by a hydraulic system 142 (FIG. 1) operably connected to the programmable system controller 54 for controlled coordinated operation of the sweep unit 52 and the roll former 51. By operating the actuators 71, the sweep roll carrier 62 is rotated about a vertical axis between different selected positions to thus sweep the continuous beam 53 in right or left directions and with desired sharpness and longitudinal position of the longitudinal sweep imparted into the beam 53.

Right and left horizontal axis actuators 72 (FIG. 8) extend between an inboard side of the tube sections 131-133/plates 134 on the intermediate horizontal axis frame 63 and brackets 145 on the base 61. Each actuator 72 includes a cylinder 140 and extendable rod 141 controlled by the hydraulic system 142 operably connected to the programmable system controller 54 for controlled coordinated operation of the sweep unit 52 and the roll former 51. By operating the actuators 72, the sweep roll carrier 62 is rotated about a horizontal axis between different selected positions to thus sweep the continuous beam 53 in up or down with desired sharpness and longitudinal position of the longitudinal sweep imparted into the beam 53. By selectively operating the actuators 71 and 72, a vertical or horizontal or angled sweep can be impacted anywhere along a length of the continuous beam 53. In the case of bumper reinforcement beams (called "beam segments" 55 hereinafter) the continuous beam 53 is cut into sections, the various selected sweeps are symmetrically and repeatedly performed along a length of the continuous beam so that by cutting the continuous beam 53 at key locations, the beam segments 55 are longitudinally symmetrical when divided by a transverse vertical plane through a longitudinal center of the beam segment 55. (See FIGS. 2-3.)

Figure 7:
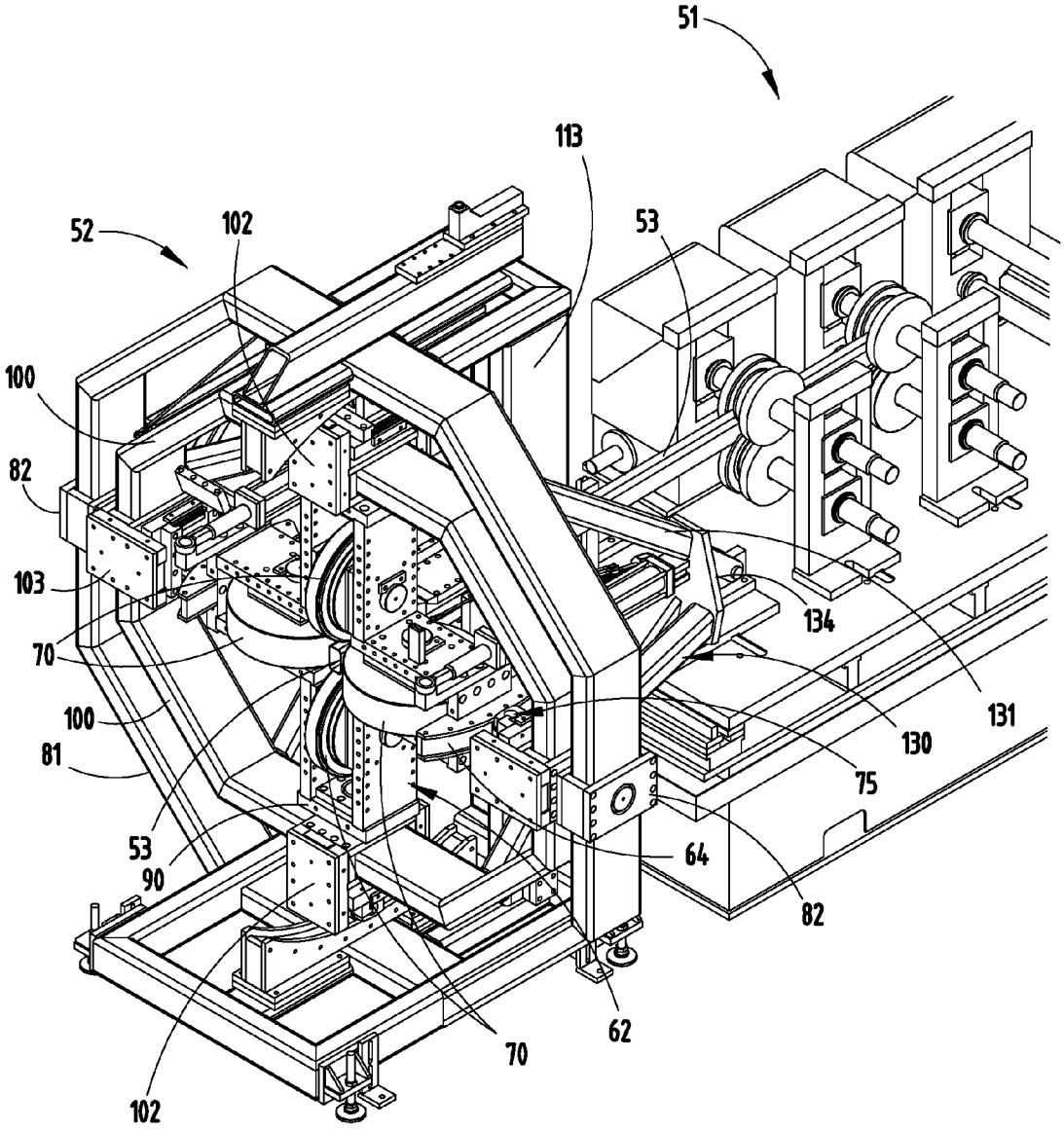
FIGS. 7-8 are perspective views of a downstream-side and an upstream-side of the sweep unit at an end of the roll former in FIG. 1.
Figure 24:
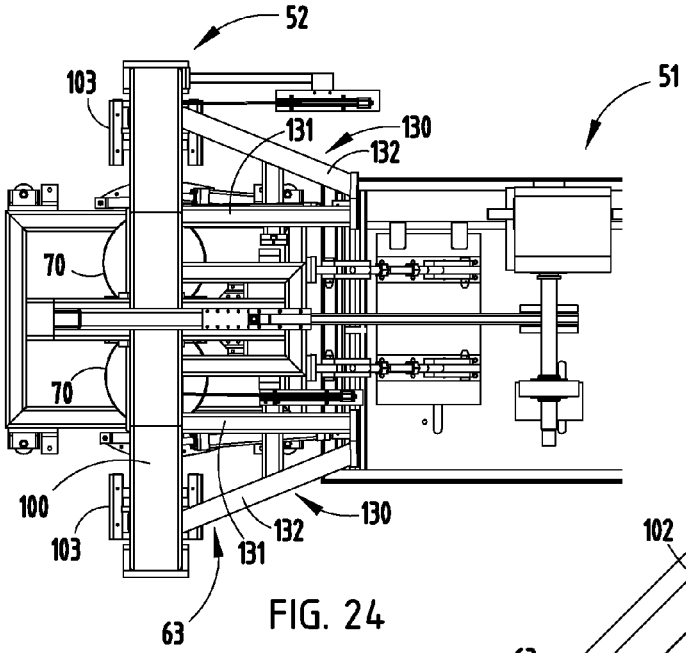
FIGS. 24-26 are top, LH side and downstream-side views of the sweep unit with sweep-producing components positioned to produce zero sweep in the continuous beam.
Figure 26:
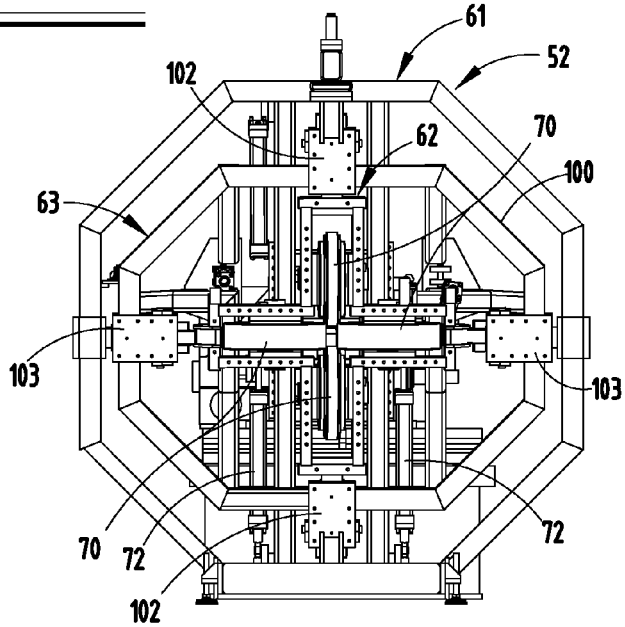
Figure 25:
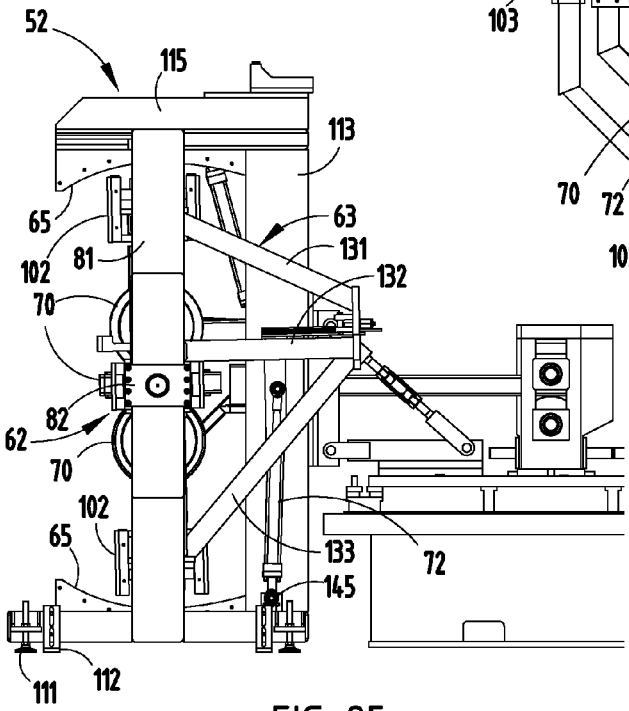
Figure 27:
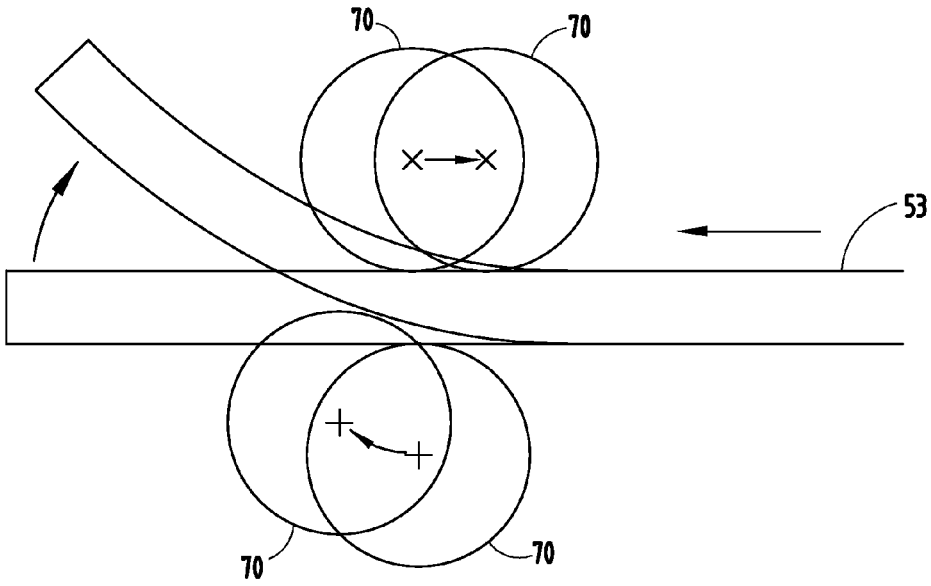
FIGS. 27-28 are schematic LH side views of the sweep unit including a pair of sweep-producing form rolls deforming the continuous beam in an upward direction (FIG. 27) and downward direction (FIG. 28).
Figure 28:
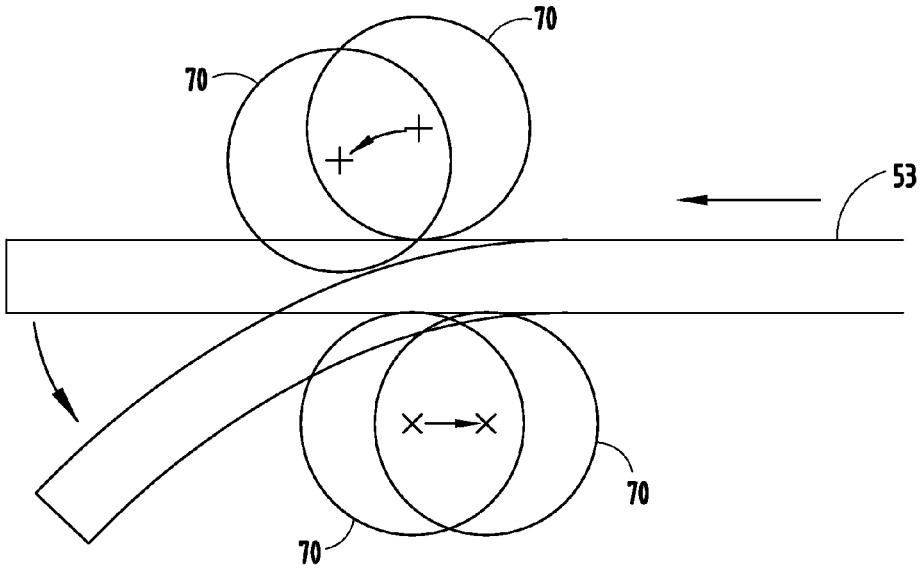
Figure 29:
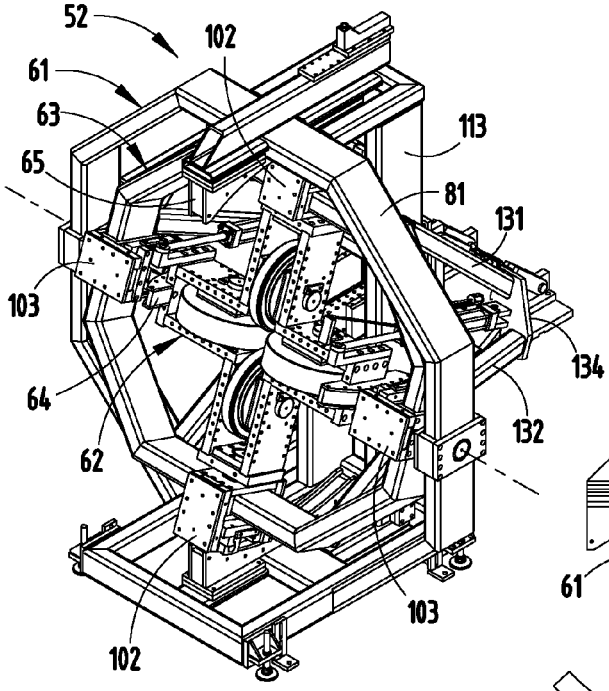
FIGS. 29-31 are downstream-side perspective, upstream-side perspective, and LH side views with sweep-producing components positioned to produce an upward sweep in the continuous beam, FIGS. 29-31 being generally similar to FIGS. 7, 8, and 25, respectively, except for being in a beam-upward-deforming position.
Figure 31:
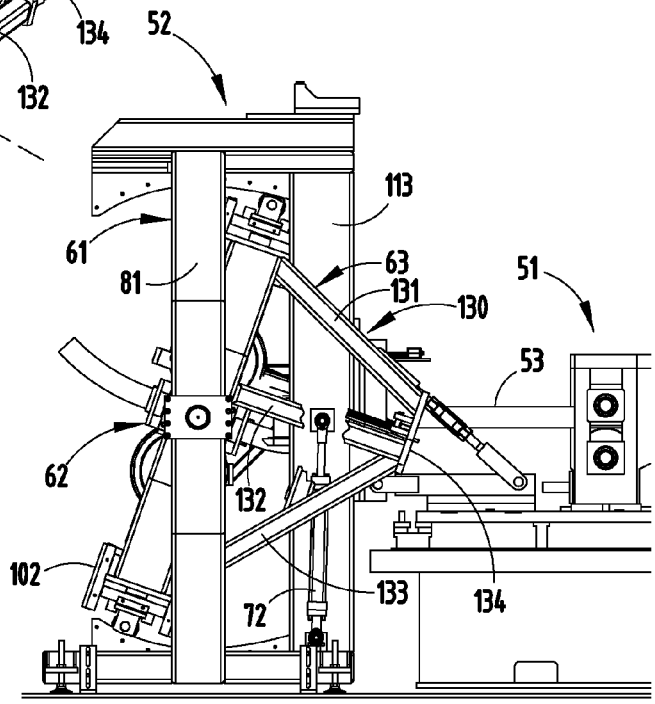
Figure 30:
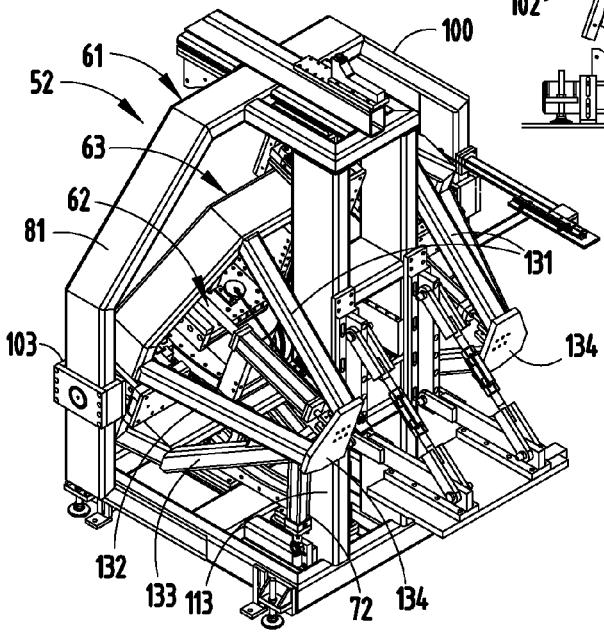
Figure 32:
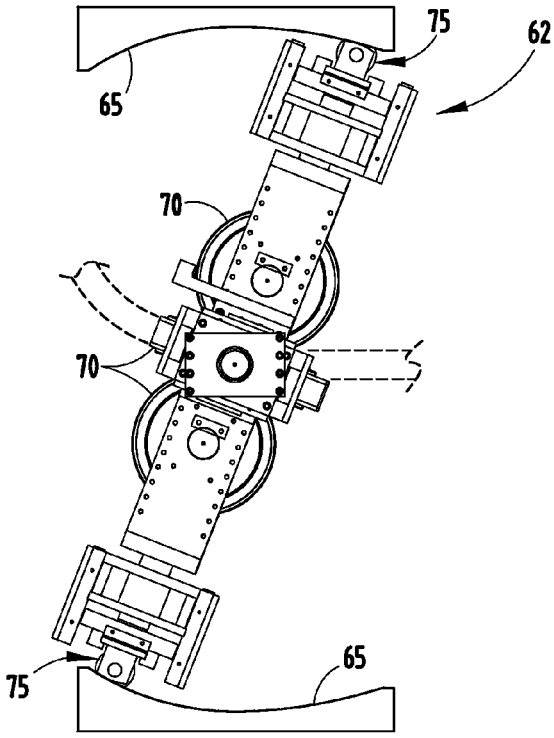
FIG. 32 is similar to FIG. 31 but shows only the sweep-producing rolls and the bearing support arrangements for same, all positioned to deform the continuous beam upwardly.
Figure 33:
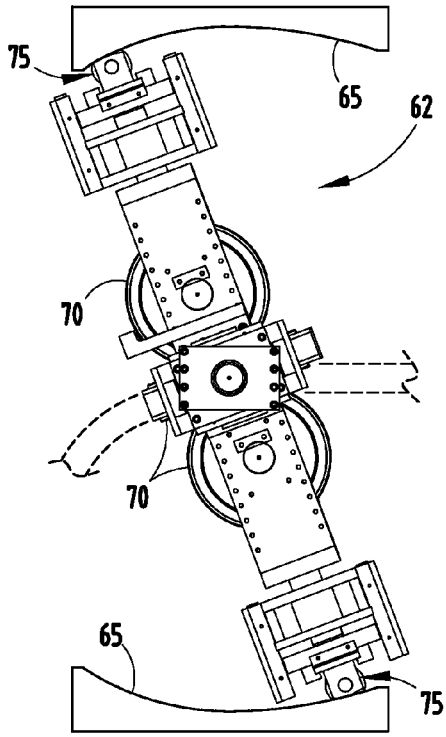
FIG. 33 is similar to FIG. 32 but shows only the sweep-producing rolls and the bearing support arrangements for same, all positioned to deform the continuous beam downwardly.
Figure 34:
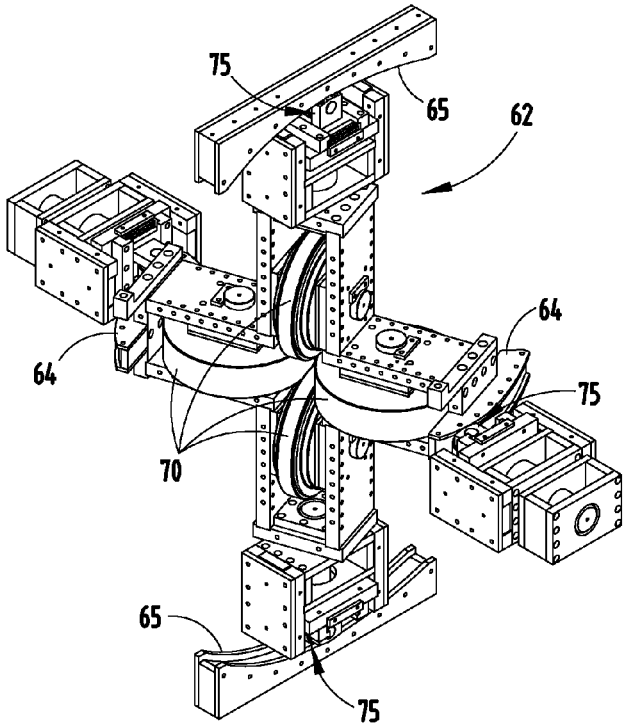
FIGS. 34-36 are downstream-side perspective, top and LH side views with sweep-producing components positioned to produce a left-hand horizontal sweep in the continuous beam, FIGS. 34-36 being generally similar to FIGS. 7, 8, and 25, respectively, except for being in a beam-left-deforming position.
Figure 35:
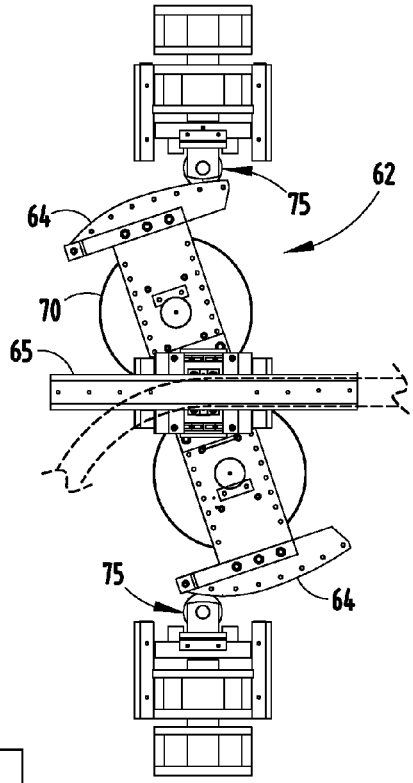
Figure 36:
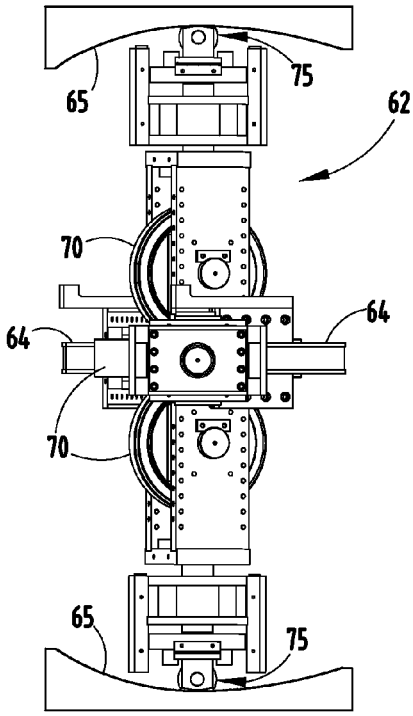
Figure 37:
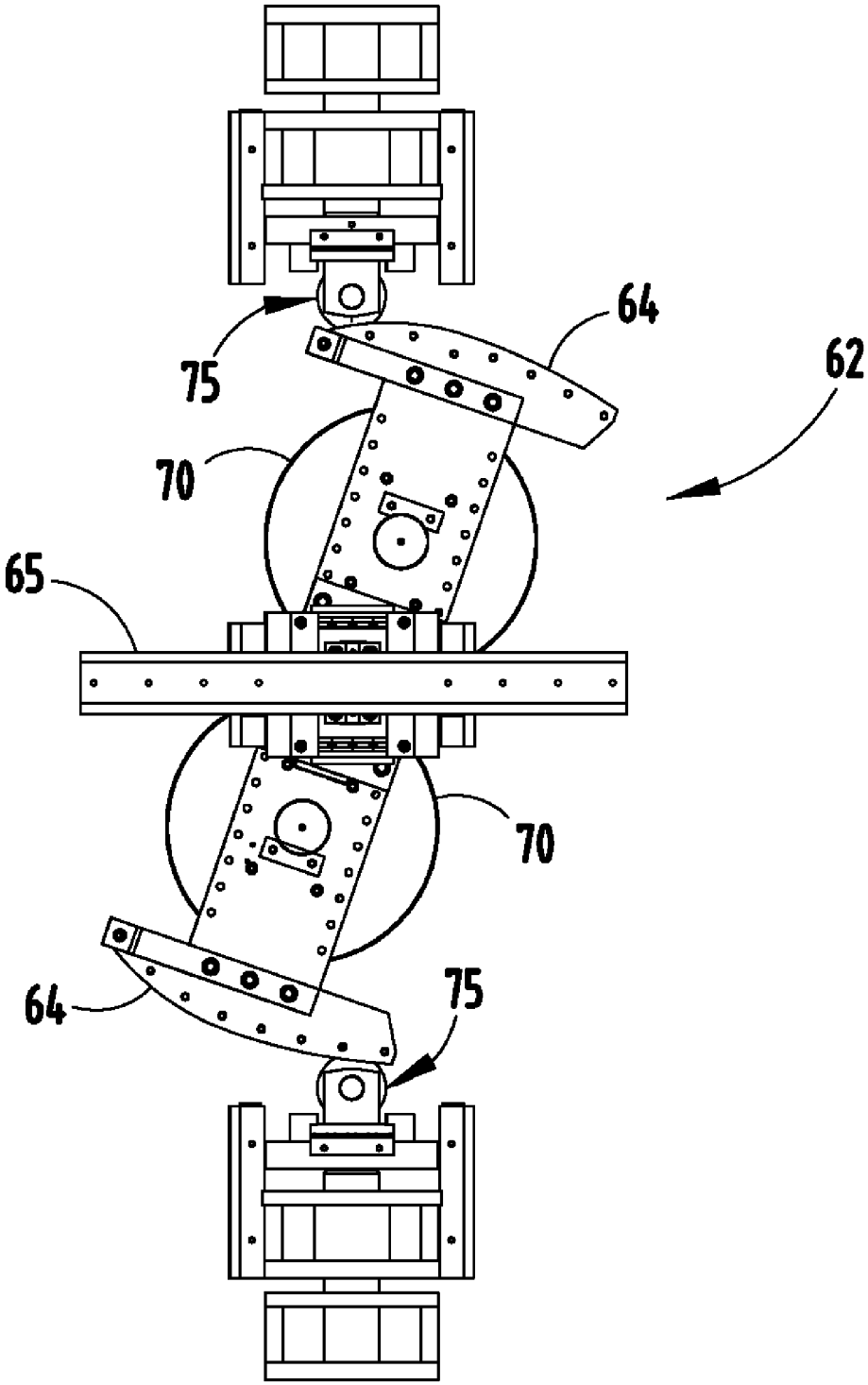
FIG. 37 is similar to FIG. 35 but being in a right-hand horizontal sweep deforming position.
Figure 38:
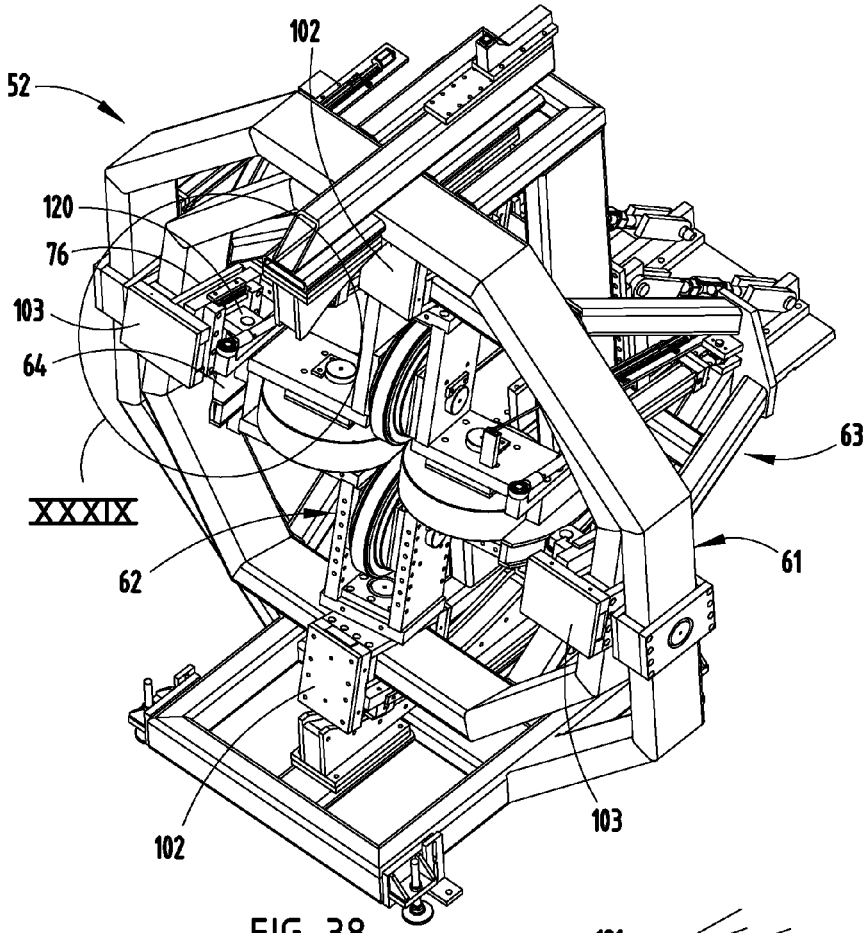
FIG. 38 is an enlarged perspective view similar to FIG. 29.
Figure 39:
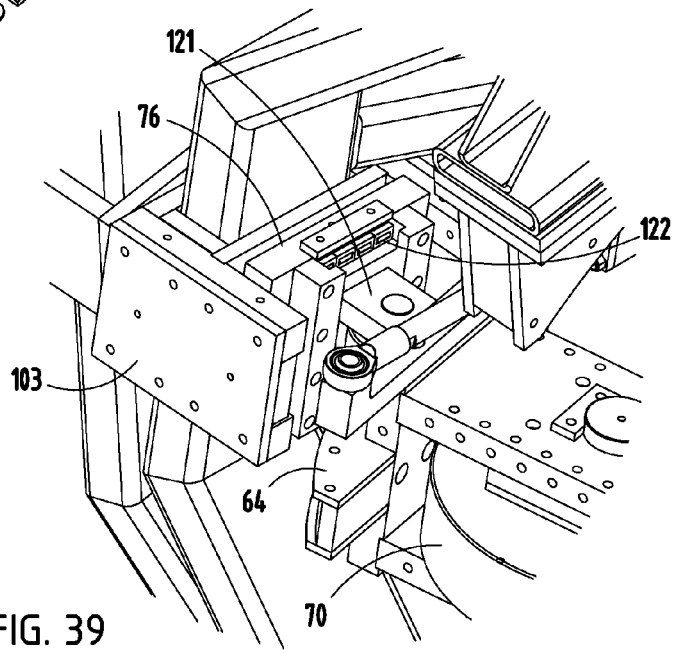
FIG. 39 is a further enlarged fragmentary perspective view of the circled area in FIG. 38.
Figure 40:
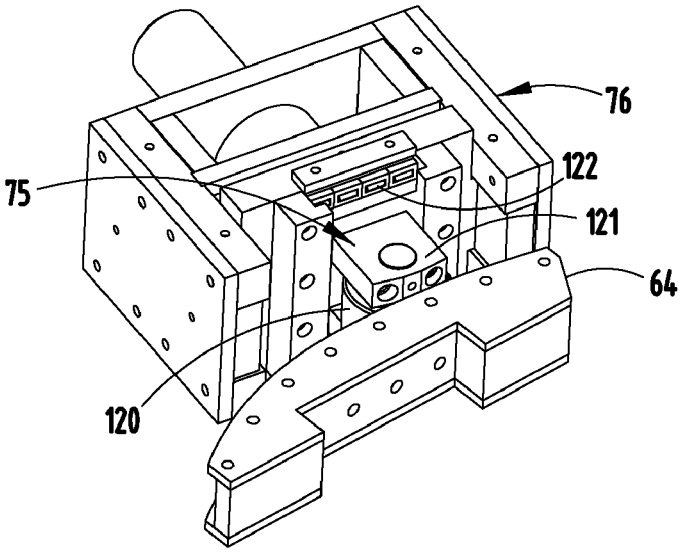
FIGS. 40-41 are perspective/assembled and perspective/exploded views of the inside bearing support arrangement for RH and LH sweeping of the continuous beam from FIG. 39.
Figure 41:
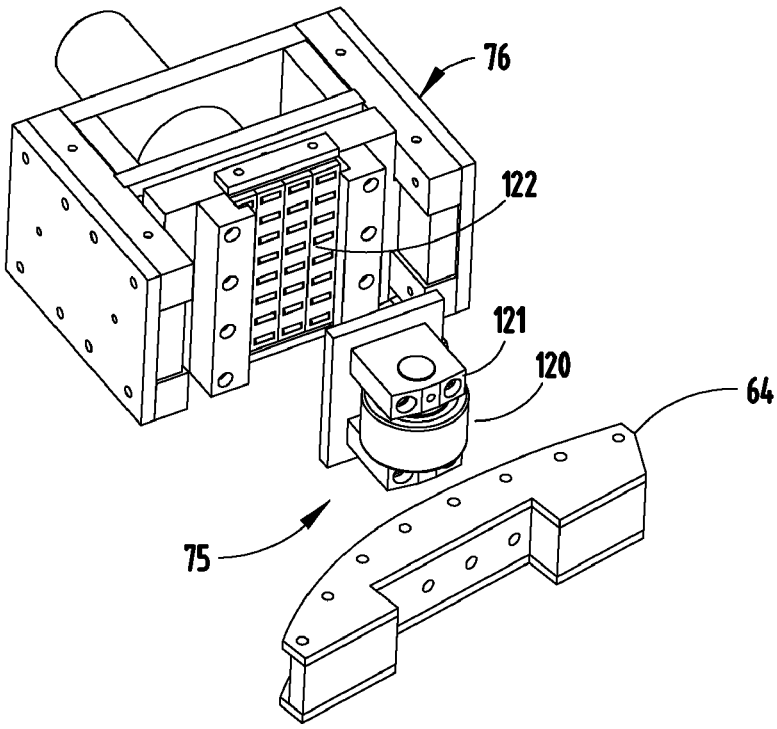
Figure 42:
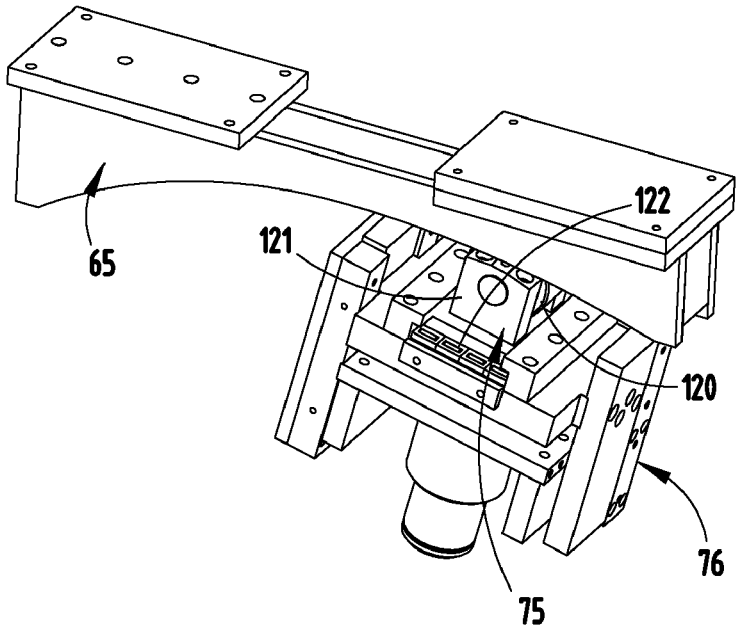
FIGS. 42-43 are perspective/assembled and perspective/exploded views of the outer/top bearing support arrangement for upward and downward sweeping of the continuous beam.
Figure 43:
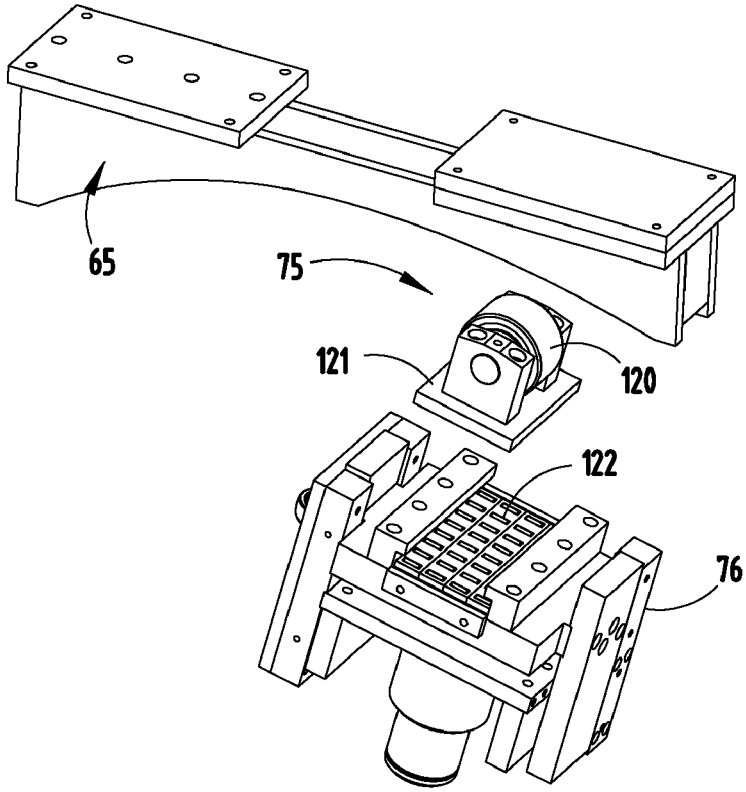

When in a neutral position (FIGS. 7-8, 18-21, 24-26) (i.e., the sweep unit 52 is positioned to not deform the continuous beam 53, such that the continuous beam 53 remains linear as roll formed and is not bent out of line level), the structural rings 81 and 100 (FIG. 7) (and the roll carrier 62) are in a coplanar position (FIGS. 24-26), with the multiple tube sections of the two structural rings 81 and 100 lying in a common vertical plane perpendicular to the line level. Axle-receiving bearings 102 (FIG. 9) are located on top and bottom sections of the inner structural ring 100 for receiving vertical axles 66 of the vertical axis frame 62, and axle-receiving bearings 103 are located on right and left sections of the inner structural ring 100 for receiving horizontal axles 67 of the main frame 61.

The adjustable attachment frame 69 (FIGS. 22-23) includes a base plate 150 and structural linkage 151-153 forming a triangle, the angled linkage 153 being adjustable so that the frame 69 can be adjusted to an aligned condition at an end of the roll mill. The vertical linkage 152 is bolted to the base 61 of the sweep unit 52.

It is contemplated that a snake-like internal mandrel (including a series of interconnected internal mandrels shaped to fill an inside of a cavity in a tubular beam) can be used inside of the continuous beam 53 if required. The internal mandrel (not specifically shown, but see Sturrus U.S. Pat. No. 5,092,512 or U.S. Pat. No. 5,454,504) is located between (and potentially extends upstream of and/or downstream of) the pinch-point of the forming rolls 70, and is anchored upstream by a cable that extends into the roll mill to a location upstream of where the (tubular) beam is closed and welded shut. A detailed explanation of the snake-like internal mandrel and upstream cable anchor is not required, but for example, the reader is invited to see the disclosure of Sturrus U.S. Pat. Nos. 5,092,512 and 5,454,504. It is noted that if present, internal mandrel would be designed for bending in all directions, so that the internal mandrel does not limit the multi-directional bending capabilities of the sweep unit 52. This can be accomplished in different ways, such as by providing a relatively-short single block, a string of short blocks connected together by universal joints, a flexible resiliently-bendable block, and/or a series of blocks interconnected with multiple non-parallel axles for multi-axial bending.

The backup block 68 (FIG. 9) is positioned in close proximity to carrier 62 and/or rolls 70 slightly upstream of the rolls 70 when the sweep unit 52 is positioned in its neutral non-sweeping position. The backup block 68 supports the continuous beam 53 (FIGS. 7-8) as it passes between the uprights 113/114 into the sweep unit 52, helping keep continuous beam 53 linear by supporting an upstream portion of the beam 53 (ahead of the sweep station) in the line level condition with the roll mill 51 during the sweeping process. As illustrated, the stroke of the illustrated actuators 71 and 72 limit the maximum angular rotation of the carrier 62, but it is noted that a front end of the backup block 68 will engage the rolls 70 if the carrier 62 or intermediate frame 63 rotates too far. It is also contemplated that a limiting stop or anchor or other means could be added if desired. The downstream end of the backup block 68 is cut with radiused surfaces so that it can extend into the pinch point area of sweep rollers 70 in a position very close and adjacent the upstream side of the rolls 70 in the sweep unit 52.

Cam yoke roller and mounts 75 and cam yoke roller guide mechanisms 76 are mounted to operably engage the bearing surfaces of bearing races 64 and 65 (FIGS. 18-21, 38-43). Specifically, guide mechanisms 76 are positioned on top and bottom sections of the inner structural ring 100 and face outwardly toward outer structural ring 81, and cam yoke roller and mounts 75 are positioned on the guide mechanisms 76 so that the associated roller 70 rollingly engages the bear races 65. When one support roller 75 moves upstream, the bearing race 65 is shaped so that the associated forming roll 70 moves linearly parallel the continuous beam 53 in an upstream direction linearly parallel the line level. Thus the forming roll 70 that is moved upstream continuously engages the beam 53.

Simultaneously, as the one support roller 75 moves the sweep roll 70 upstream, it's opposing support roller 75 moves downstream sweep roll 70 along the associated bearing race, constantly maintaining a same distance between the two opposing rolls 70. This causes the opposing forming roll 70 to move across the line level along a path B in an increasingly sharper transverse direction. As the roll 70 moves downstream, it maintains a same distance to the upstream-moving roller 70. This results in a very stable bending action, where the continuous beam 53 is drawn around a first (upstream) one of the forming rolls 70 by a downstream movement of an opposing forming roll 70.

Notably, the pair of opposing forming rolls 70 can be moved to bend the continuous beam in either up or down vertical directions (FIGS. 27-28, 29-32, 33). The support rollers 75 interact with associated races to maintain a continuous contact of the forming rolls 70 with opposing sides of the continuous beam 53. This is important for at least the following reason. When tubes (i.e., the continuous beam 53) made of high strength steels and/or with large cross sections (such as 3×4 inches) are bent, the beam walls that extend parallel the direction of the bend tend to be compressed at one end of the walls and stretched at an opposite end of the walls. Also, the remaining beam walls forming inside and outside radii of the bend are placed in compression and tension, respectively. However, high strength steels resist compression. Thus, any beam wall undergoing large compressive forces tends to become unstable and to undulate in an uncontrolled manner, bending wildly, and potentially kinking or bending out of its desired orthogonal shape. At a minimum, dimensional consistency and control of the cross-sectional shape and uniformity of the sweep is severely compromised and/or lost.

Guide mechanisms 76 are also positioned on right and left sections of the inner structural ring 100 and face inwardly toward outer structural ring 81, and cam yoke roller and mounts 75 are positioned on the guide mechanisms 76 so that the associated roller 70 rollingly engages the bearing races 64. As one support roller 75 moves upstream, the bearing race 64 is shaped so that the associated forming roll 70 moves linearly parallel in an upstream direction "A" along the line level to cause the forming roll 70 to continuously engage the beam 53. Simultaneously, as the one support roller 75 moves upstream, it's opposing support roller 75 moves downstream along the associated bearing race. This causes the opposing forming roll 70 to move across the line level along a path B. This results in a very stable bending action, where the continuous beam is drawn around a first one of the forming rolls 70 by a downstream movement of an opposing forming roll 70. Notably, the pair of opposing forming rolls 70 can be moved to bend the continuous beam in either horizontal direction.

A speed, extent, and timing of movement of any of the forming rolls 70 is controlled by controller 54 which controls the actuators (cylinders 71 and 72), and a position of the components (and degree of sweep generated) is given by the sensors 73 and 74. Further, by combined movement of the forming rolls 70 about the vertical and horizontal axes, any direction of sweep can be imparted into the continuous beam 53, including a vertical sweep, a horizontal sweep, and angled sweep(s) angled in a direction between vertical and horizontal. See FIGS. 2-3 which illustrate a bumper reinforcement component (55) having a center section 56 moved both down vertically upward (direction C) and horizontally forward (direction D) from co-aligned end sections 57 (when the bumper segment 55 is in a vehicle-mounted position).

In the sweep unit 52, the sweep is caused by wrapping the continuous beam around a downstream side of the opposing sweep roll 70, regardless of which direction the sweep is being formed in. This in our opinion provides a better distribution of forces on the beam during the sweeping process, and in particular tends to provide a greater zone of tension and lesser zone of compression. Notably, high tensile strength steels deform more predictably through tension and much less predictably in compression. This is due in part to the fact that when compressed, high tensile strength steels do not tend to shorten in length and gain wall thickness, but instead they tend to undulate and form snake-like back-and-forth bends while maintaining a same total wall length. It is contemplated that the capabilities of the illustrated present sweep unit can be further enhanced by placing motors on each of the sweep rolls 70, each being independently driven so that during a sweeping operation, the controller can set optimal axle speeds to optimize tensile forces and material stretching (and minimize or at least control compressive forces), thus optimizing bending uniformity and minimizing snake-like undulations in the swept portions of the beam.

The present method is configured to make non-linear structural components of high strength materials. The method includes providing a roll former with rolls configured to form a continuous beam from sheet material and defining a line level, and including a sweep unit adjacent the roll former and constructed to automatically selectively sweep the continuous beam away from the line level in multiple different directions not lying in a single plane, and including a controller operably connected to the roll former and the sweep unit for simultaneously controlling same. The method further includes roll forming a first structural beam segment, including deforming the continuous beam to have repeating identical first beam segments each with first longitudinal sections defining a first set of sweeps lying in at least two different planes. The method further includes roll forming a second structural beam including deforming the continuous beam to have repeating identical second beam segments each with second longitudinal sections defining a second set of sweeps lying in at least two different planes; with at least one of the sweeps in the first and second set of sweeps being different in radius or longitudinal length or direction or plane, such that the first and second beam segments define longitudinally-different three-dimensional shapes.

The present method contemplates forming bumper reinforcement beams by providing a roll former with forming rolls configured to form a continuous beam from sheet material and defining a line level, and including a sweep unit with sweeping rolls constructed to automatically selectively sweep the continuous beam away from the line level in multiple different directions not lying in a single plane. The present method further contemplates roll forming a first structural bumper reinforcement beam with a center section and end sections and transition sections connecting the center and end sections, the first beam when in a vehicle mounted position having its center section located a horizontal distance H1 from a line connecting ends of the end sections and a vertical distance V1 from the line connecting the ends of the end sections; and also contemplates roll forming a second structural bumper reinforcement beam with a center section and end sections and transition sections connecting the center and end sections, the second beam when in a vehicle mounted position having its center section located a horizontal distance H2 from a line connecting ends of the end sections and a vertical distance V2 from the line connecting the ends of the end sections; wherein one or both of the numbers generated by (H1 minus H2) and (V1 minus V2) is non-zero, such that the first and second beams are different shapes. The method includes securing mounts onto the beam for attachment to a vehicle frame, such as by welding, and assembling at least one of the first structural bumper reinforcement beams onto a first vehicle; and assembling at least one of the second structural bumper reinforcement beams onto a second vehicle.

The present method further contemplates manufacturing a structural component by roll forming sheet material into a continuous beam defining a longitudinal line level and sweeping the continuous beam in-line with the step of roll forming, including selectively sweeping the beam away from the longitudinal line level in both vertical and horizontal directions.

The present method includes manufacturing a structural component comprising steps of roll forming sheet material into a continuous beam defining a longitudinal line level and at least one horizontal planar wall section and at least one vertical planar wall section, and sweeping the continuous beam in-line with the step of roll forming, including selectively longitudinally sweeping the beam at an angle between vertical and horizontal directions.

The present method includes a bumper beam development including steps of using existing tooling to roll form and then selectively sweep a continuous beam from sheet material and thereafter cutting the continuous beam into non-linear first beam segments, each having a center section, end sections and transition sections that position the center section a vertical distance V1 and horizontal distance H1 from a line connecting ends of the beam segments when in a vehicle mounted position. The method further includes again using the existing tooling but changing a programmed controller to form non-linear second beam segments, each having a center section, end sections, and transition sections but that position the center sectional vertical distance V2 and horizontal distance H2, at least one of (V1 minus V2) and (H1 minus H2) being non-zero, and testing the second beam segments for impact characteristics against FMVSS and insurance bumper impact standards.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A method comprising steps of:

providing a roll former with rolls constructed to form sheet material into a structural beam defining a longitudinal line level; and providing a sweep unit in-line with the roll former; and selectively sweeping the beam away from the longitudinal line level in both vertical and horizontal directions during continuous operation of the roll former by selectively moving four orthogonally-related forming rolls that rollingly engage four sides of the structural beam in at least one of an upstream and downstream direction.

2. The method defined in claim 1, wherein the rolls include at least one forming roll that can be moved in an upstream and downstream direction, and wherein the step of selectively sweeping the beam includes selectively adjusting a position of the at least one forming roll so that, when moved in the upstream direction, a beam-engaging contact point of the at least one forming roll with the continuous beam continues to support the continuous beam but does not deform the continuous beam out of line level, but so that, when moved in a the downstream direction, the beam-engaging contact point of the at least one forming roll moves along a path that forces the continuous beam to deform out of line level.

3. The method defined in claim 1, wherein the step of providing a roll former constructed to form a structural beam includes a step of roll forming a continuous beam, and wherein the step of selectively sweeping the beam includes deforming the continuous beam to have repeating identical first beam segments each with first longitudinal sections defining a first set of sweeps lying in at least two different planes; and wherein the step of selectively sweeping further includes deforming the continuous beam to have repeating identical second beam segments each with second longitudinal sections defining a second set of sweeps lying in at least two different planes; with at least one of the sweeps in the first and second set of sweeps being different in radius or longitudinal length or direction or plane, such that the first and second beam segments define longitudinally-different three-dimensional shapes.

4. The method defined in claim 1, wherein the step of providing a roll former constructed to form a structural beam includes a step of roll forming a continuous beam, and wherein the step of selectively sweeping the beam includes roll forming a first structural bumper reinforcement beam with a center section and end sections and transition sections connecting the center and end sections, the first beam when in a vehicle mounted position having its center section located a horizontal distance H1 from a line connecting ends of the end sections and a vertical distance V1 from the line connecting the ends of the end sections; and also includes roll forming a second structural bumper reinforcement beam with a center section and end sections and transition sections connecting the center and end sections, the second beam when in a vehicle mounted position having its center section located a horizontal distance H2 from a line connecting ends of the end sections and a vertical distance V2 from the line connecting the ends of the end sections; wherein one or both of the numbers generated by (H1 minus H2) and (V1 minus V2) is non-zero, such that the first and second beams are different shapes; and still further includes assembling at least one of the first structural bumper reinforcement beams onto a first vehicle; and assembling at least one of the second structural bumper reinforcement beams onto a second vehicle.

5. The method defined in claim 1, wherein the step of providing a roll former constructed to form a structural beam includes a step of roll forming a continuous beam, and wherein the step of selectively sweeping the beam includes using existing tooling to roll form and then selectively sweep a continuous beam from sheet material and thereafter cutting the continuous beam into non-linear first beam segments, each having a center section, end sections and transition sections that position the center section a vertical distance V1 and horizontal distance H1 from a line connecting ends of the beam segments when in a vehicle mounted position;

again using the existing tooling but changing a programmed controller to form non-linear second beam segments, each having a center section, end sections, and transition sections but that position the center sectional vertical distance V2 and horizontal distance H2, at least one of (V1 minus V2) and (H1 minus H2) being non-zero; and testing the second beam segments for impact characteristics against FMVSS and insurance bumper impact standards.

6. The method defined in claim 1, wherein the step of providing a sweep unit includes providing forming rolls engaging four sides of the structural beam, a main frame, a vertical axis frame, and a horizontal axis frame, the vertical and horizontal axis frames adjustably carrying the forming rolls for adjustable movement in upstream and downstream directions to selectively sweep the structural beam in selected different directions from the line level; and wherein the step of selectively sweeping the beam includes selectively adjusting the forming rolls to selectively sweep the structural beam in the selected different directions from the line level.

7. The method defined in claim 6, wherein the sweep unit includes only one vertical axis frame and only one horizontal axis frame and only one set of forming rolls.

8. The method defined in claim 6, wherein at least one of the vertical and horizontal axis frames form a geometrically-shaped closed loop through which the structural beam extends.

9. A method comprising steps of:

providing a roll former with rolls constructed to form sheet material into a structural beam defining a line level;

providing a sweep unit downstream of the roll former, the sweep unit including beam-deforming components and a structural ring supported by a curvilinear bearing that supports the beam-deforming components for selective movement; and selectively repeatedly sweeping the beam as the beam exits the roll former along multiple different planes and with varying radii by selective movement of the beam-deforming components upstream parallel the line level and selective movement downstream into the line level.

10. A method comprising steps of:

providing a roll former adapted to roll form a sheet into a continuous beam defining a line level;

providing a sweep unit attached to the roll former with opposing rollers configured to impart a longitudinal sweep into the continuous beam in any direction vertically or horizontally or at angles in-between, the opposing rollers including at least one pair of opposing first forming rollers and including at least one pair of opposing second forming rollers, and including curvilinear bearings that operably support the opposing first and second forming rollers for movement; and selectively imparting at least two different sweeps into the beam, including moving one of the pair of first forming rollers linearly upstream while another of the pair of first forming rollers is moved downstream along a curvilinear line into the line level.

11. A method comprising steps of:

providing a roll former with rolls configured to form a structural beam from sheet material; and providing a sweep unit having a first pair of forming rolls positioned to engage first opposing sides of the structural beam and having a second pair of forming rolls positioned to engage second opposing sides of the structural beam, the first and second pair of forming rolls being operably supported on curvilinear bearings that supports movement along a multi curved path, that extend along an upstream direction; and operating the sweep unit so that all of the first and second pairs of forming rolls move along the bearings to continuously engage the beam, but so that at least one pair of the first and second pairs of forming rolls move so that one of the forming rolls in the one pair moves downstream and into a line level of the structural beam while maintaining a constant distance to the other of the one pair of forming rolls.

* * * * *